US011399417B2

(12) United States Patent
Suga et al.

(10) Patent No.: US 11,399,417 B2
(45) Date of Patent: Jul. 26, 2022

(54) INDUCTION HEATING COOKER

(71) Applicants: Mitsubishi Electric Corporation, Tokyo (JP); Mitsubishi Electric Home Appliance Co., Ltd., Saitama (JP)

(72) Inventors: Ikuro Suga, Tokyo (JP); Tetsuya Matsuda, Tokyo (JP); Kazuhiro Kameoka, Fukaya (JP)

(73) Assignees: Mitsubishi Electric Corporation, Tokyo (JP); Mitsubishi Electric Home Appliance Co., Ltd., Fukaya (JP)

( * ) Notice: Subject to any disclaimer, the term of this patent is extended or adjusted under 35 U.S.C. 154(b) by 426 days.

(21) Appl. No.: 16/494,373

(22) PCT Filed: Jun. 5, 2017

(86) PCT No.: PCT/JP2017/020783
§ 371 (c)(1),
(2) Date: Sep. 16, 2019

(87) PCT Pub. No.: WO2018/225120
PCT Pub. Date: Dec. 13, 2018

(65) Prior Publication Data

US 2020/0245415 A1 Jul. 30, 2020

(51) Int. Cl.
*H05B 6/12* (2006.01)
*H05B 6/06* (2006.01)

(52) U.S. Cl.
CPC ..... *H05B 6/1272* (2013.01); *H05B 6/065* (2013.01); *H05B 6/1281* (2013.01)

(58) Field of Classification Search
CPC .... H05B 6/065; H05B 6/1272; H05B 6/1281; Y02B 40/00
(Continued)

(56) References Cited

U.S. PATENT DOCUMENTS 4,792,652 A * 12/1988 Seguy ..... H05B 6/1272 336/232
5,808,280 A * 9/1998 Gaspard ..... H05B 6/1272 219/626
2018/0359820 A1* 12/2018 Acero Acero ..... H05B 6/1272

FOREIGN PATENT DOCUMENTS

EP 2 405 714 A1 1/2012
JP 2007305510 A 11/2007
(Continued)

OTHER PUBLICATIONS

Office Action dated Sep. 15, 2020 issued in corresponding JP patent application No. 2019-523215 (and English translation).
(Continued)

*Primary Examiner* — Quang T Van
(74) *Attorney, Agent, or Firm* — Posz Law Group, PLC

(57) ABSTRACT

An induction heating cooker according to the present invention has a top plate on which a heater area indication indicating a mount position of to-be-heated object is formed, and a first coil and a second coil that are formed of an annular coil arranged below the heater area indication of the top plate, the second coil includes a first winding portion extending in a circumferential direction of the first coil, and a second winding portion spaced apart from the first winding portion and extending in the circumferential direction of the first coil, and the distance between the first winding portion and the top plate is different from the distance between the second winding portion and the top plate.

22 Claims, 13 Drawing Sheets

(58) Field of Classification Search
USPC ..... 219/624, 621, 625–627, 647, 660–662, 219/665–669, 671, 672, 675, 477, 480, 219/482, 486, 489, 508
See application file for complete search history.

(56) References Cited

FOREIGN PATENT DOCUMENTS

| | | | |
|---|---|---|---|
| JP | 2010015764 | A | 1/2010 |
| JP | 2011-243413 | A | 12/2011 |
| JP | 2011243405 | A | 12/2011 |
| JP | 2011258339 | A | 12/2011 |
| JP | 5289555 | B2 | 9/2013 |
| JP | 2017084833 | A | 5/2017 |
| WO | 2010/101135 | A1 | 9/2010 |

OTHER PUBLICATIONS

International Search Report of the International Searching Authority dated Aug. 29, 2017 for the corresponding International application No. PCT/JP2017/020783 (and English translation).

* cited by examiner

INDUCTION HEATING COOKER

CROSS REFERENCE TO RELATED APPLICATION

This application is a U.S. national stage application of PCT/JP2017/020783 filed on Jun. 5, 2017, the contents of which are incorporated herein by reference.

TECHNICAL FIELD

The present invention relates to an induction heating cooker including a plurality of coils.

BACKGROUND ART

A conventional induction heating cooker includes a center coil, a plurality of peripheral coils arranged around and to be adjacent to the center coil, and a high-frequency power supply that supplies a high-frequency current to the center coil and the peripheral coils. The high-frequency power supply supplies a high-frequency current flowing in the same direction in a region in which the center coil and the peripheral coils are adjacent to each other (for example, see Patent Literature 1).

CITATION LIST

Patent Literature

Patent Literature 1: International Publication No. 2010/101135

SUMMARY OF INVENTION

Technical Problem

In the conventional induction heating cooker, the direction of a current flowing through an inside portion of each peripheral coil that is adjacent to the center coil is opposite to the direction of a current flowing through an outside portion of the peripheral coil that is not adjacent to the center coil. Thus, there is a problem in that a portion of the magnetic field generated by the current flowing through the inside portion of the peripheral coil and a portion of the magnetic field generated by the current flowing through the outside portion of the peripheral coil cancel each other out.

The present invention has been made to solve the above-described problem and provides an induction heating cooker that can suppress magnetic field cancellation in a case where a to-be-heated object is heated through induction.

Solution to Problem

An induction heating cooker according to an embodiment of the present invention has a top plate on which a heater area indication indicating a mount position of to-be-heated object is formed, and a first coil and a second coil that are formed of an annular coil arranged below the heater area indication of the top plate, the second coil includes a first winding portion extending in a circumferential direction of the first coil, and a second winding portion spaced apart from the first winding portion and extending in the circumferential direction of the first coil, and the distance between the first winding portion and the top plate is different from the distance between the second winding portion and the top plate.

Advantageous Effects of Invention

In an induction heating cooker according to an embodiment of the present invention, the distance between a first winding portion of a second coil and a top plate differs from the distance between a second winding portion of the second coil and the top plate. Thus, it is possible to reduce the degree to which the magnetic field generated by a current flowing through the first winding portion and the magnetic field generated by a current flowing through the second winding portion cancel each other out.

DESCRIPTION OF EMBODIMENTS

Embodiment 1

Figure 1:
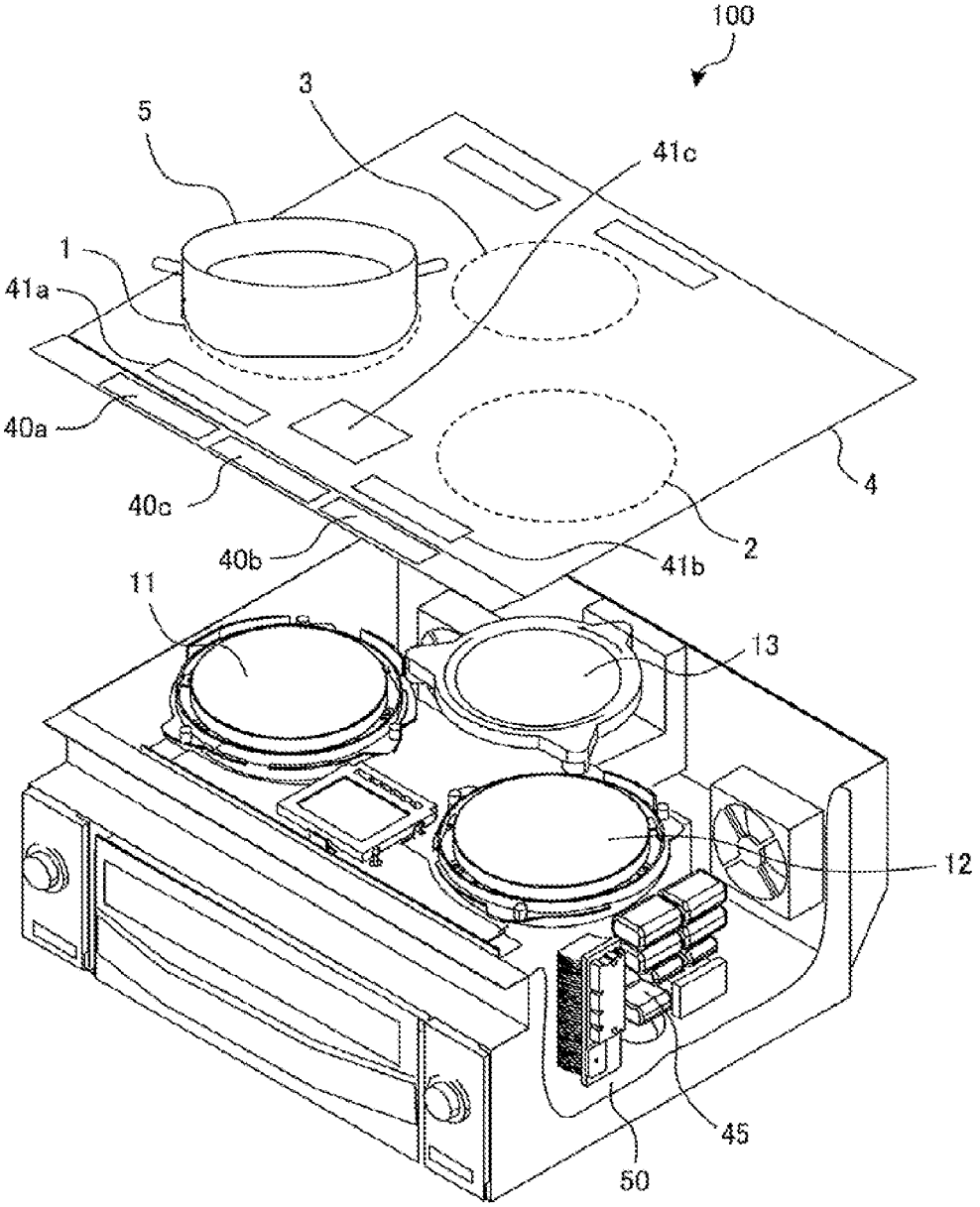
FIG. 1 is an exploded perspective view illustrating an induction heating cooker according to Embodiment 1.

FIG. 1 is an exploded perspective view illustrating an induction heating cooker according to Embodiment 1.

As illustrated in FIG. 1, an induction heating cooker 100 has, at its upper portion, a top plate 4 for mounting a to-be-heated object 5 such as a pot. The top plate 4 has a first induction heater area indication 1 and a second induction heater area indication 2 that serve as heater area indications for heating the to-be-heated object 5 through induction. The first induction heater area indication 1 and the second induction heater area indication 2 are provided side by side in a lateral direction on the front side of the top plate 4. In addition, the induction heating cooker 100 according to Embodiment 1 also has a third induction heater area indication 3 as the third heater area indication. The third induction heater area indication 3 is provided on the depth side with respect to the first induction heater area indication 1 and the second induction heater area indication 2 and at a substantially center position in the lateral direction on the top plate 4.

Below the first induction heater area indication 1, the second induction heater area indication 2, and the third induction heater area indication 3, a first induction heating unit 11, a second induction heating unit 12, and a third induction heating unit 13 for heating the to-be-heated object 5 mounted on a corresponding heater area indication are provided, respectively. Each heating unit includes a coil.

The entirety of the top plate 4 is constituted by a material through which infrared rays pass such as heat-resistant tempered glass or crystallized glass. In addition, on the top plate 4, circular pot-position marks indicating a rough pot mount position and corresponding to the heater area indications, which are s of the first induction heating unit 11, the second induction heating unit 12, and the third induction heating unit 13, are formed by, for example, application of paint or printing.

As an input device for setting, for example, input power and a cooking menu in a case where the to-be-heated object 5 or the like is heated by the first induction heating unit 11, the second induction heating unit 12, and the third induction heating unit 13, an operation unit 40 is provided on the front side of the top plate 4. Note that, in Embodiment 1, the operation unit 40 is divided on an induction heating coil basis, and includes an operation unit 40*a*, an operation unit 40*b* and an operation unit 40*c*.

In addition, a display unit 41 for displaying, for example, an operation state of each induction heating coil and an input and the content of an operation from the operation unit 40 is provided as a notification unit near the operation unit 40. Note that, in Embodiment 1, the display unit 41 is divided on the induction heating coil basis, and includes a display unit 41*a*, a display unit 41*b*, and a display unit 41*c*.

Note that the operation unit 40 and the display unit 41 are not specifically limited to, for example, a case where the units 40 and 41 are provided on an induction heating unit basis as described above and a case where the units 40 and 41 are provided as units common to the induction heating units. In this case, the operation unit 40 is constituted by, for example, mechanical switches such as a push switch and a tact switch and a touch switch that detects an input operation on the basis of a change in the capacitance of an electrode. In addition, the display unit 41 is constituted by, for example, a liquid crystal device (LCD) and a light-emitting diode (LED).

Note that the operation unit 40 and the display unit 41 may also be integrally constituted as an operation display unit 43. The operation display unit 43 is constituted by, for example, a touch panel obtained by arranging a touch switch on the top plate surface of an LCD.

Inside the induction heating cooker 100, there are provided a driving circuit 50 for supplying high frequency power to the coils of the first induction heating unit 11, second induction heating unit 12, and third induction heating unit 13 and a controller 45 for controlling the entire induction heating cooker including the driving circuit 50.

The driving circuit 50 supplies high frequency power to the first induction heating unit 11, the second induction heating unit 12, and the third induction heating unit 13, so that high frequency magnetic fields are generated from the coils of the induction heating units. Note that the configuration of the driving circuit 50 will be described in detail later.

The first induction heating unit 11, the second induction heating unit 12, and the third induction heating unit 13 are configured, for example, as in the following. Note that the first induction heating unit 11, the second induction heating unit 12, and the third induction heating unit 13 are configured substantially the same. Thus, as a representative, the configuration of the first induction heating unit 11 will be described in the following.

Figure 2:
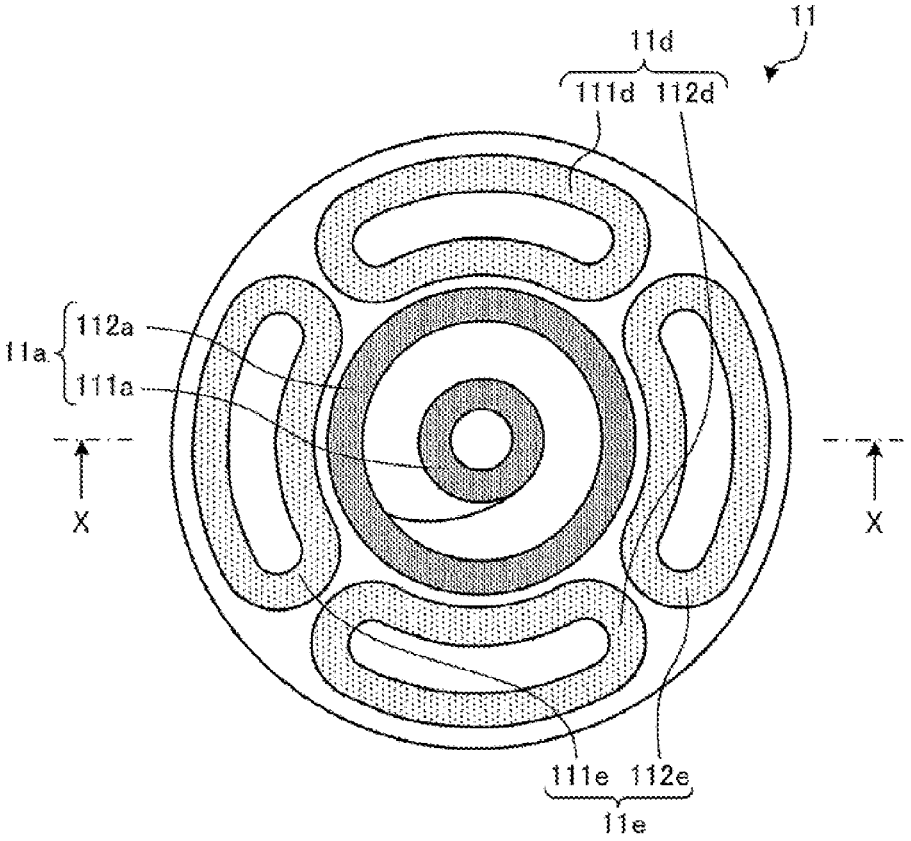
FIG. 2 is a plan view illustrating a first induction heating unit of the induction heating cooker according to Embodiment 1.

FIG. 2 is a plan view illustrating the first induction heating unit of the induction heating cooker according to Embodiment 1.

In FIG. 2, the first induction heating unit 11 is constituted by an inner periphery coil 11*a* arranged at the center of the heater area indication and an outer periphery coil 11*e* and an outer periphery coil 11*d* arranged around the inner periphery coil 11*a*. The periphery of the first induction heating unit 11 has a substantially circular shape corresponding to the first induction heater area indication 1.

The inner periphery coil 11*a* is constituted by an inner-periphery inner coil 111*a* and an inner-periphery outer coil 112*a* that are arranged concentrically. The inner-periphery inner coil 111*a* and the inner-periphery outer coil 112*a* have a circular planar shape and are constituted by a circumferentially wound insulating-coated conductive line composed of an arbitrary metal. Note that examples of a material for the conductive line include copper and aluminum.

The inner-periphery inner coil 111*a* and the inner-periphery outer coil 112*a* are connected in series and are driven and controlled by a driving circuit 50*a*, which is a single driving circuit. Note that the inner-periphery inner coil 111*a* and the inner-periphery outer coil 112*a* may also be connected in parallel, and may also be each driven by an independent driving circuit.

The outer periphery coil 11*d* is constituted by an outer-periphery upper coil 111*d* and an outer-periphery lower coil 112*d*. The outer periphery coil 11*e* is constituted by an outer-periphery left coil 111*e* and an outer-periphery right coil 112*e*. The outer-periphery upper coil 111*d* and the outer-periphery lower coil 112*d* are connected in series and are driven and controlled by a driving circuit 50*d*, which is a single driving circuit. The outer-periphery left coil 111*e* and the outer-periphery right coil 112*e* are connected in series and are driven and controlled by a driving circuit 50*e*, which is a single driving circuit.

The outer-periphery upper coil 111*d*, the outer-periphery lower coil 112*d*, the outer-periphery left coil 111*e*, and the outer-periphery right coil 112*e* are arranged around the inner periphery coil 11*a* and substantially along the contour of the circle shape of the inner periphery coil 11*a*. Note that, in the following description, the outer-periphery upper coil 111*d*, the outer-periphery lower coil 112*d*, the outer-periphery left coil 111*e*, and the outer-periphery right coil 112*e* may also referred to as "individual outer periphery coils".

The four individual outer periphery coils have a substantially ¼ arc-shaped planar shape and are constituted by winding an insulating-coated conductive line composed of an arbitrary metal along the ¼ arc-shaped shape of the individual outer periphery coil. That is, the individual outer periphery coils are configured to extend substantially along the circular planar shape of the inner periphery coil 11*a* in ¼ arc-shaped regions adjacent to the inner periphery coil 11*a*. Note that examples of a material for the conductive line include copper and aluminum. Note that the individual outer periphery coils may also be connected in parallel to each other. In addition, the outer-periphery upper coil 111*d* and the outer-periphery lower coil 112*d* may also be driven by using a single driving circuit.

Note that the number of individual outer periphery coils is not limited to four. In addition, the shape of the individual outer periphery coils is not limited to this, and for example the individual outer periphery coils may also be configured using a plurality of circular outer periphery coils. In addition, the shape of the individual outer periphery coils may also be, for example, an oval shape, a triangle shape, or a rectangle shape.

Note that, in Embodiment 1, the individual outer periphery coils are arranged around the inner periphery coil 11*a*. The reason why the individual outer periphery coils and the inner periphery coil 11*a* are not concentrically arranged is to improve power controllability of each coil by weakening electromagnetic coupling between the individual outer periphery coils and the inner periphery coil 11*a* and by reducing interference between the coils.

Figure 3:
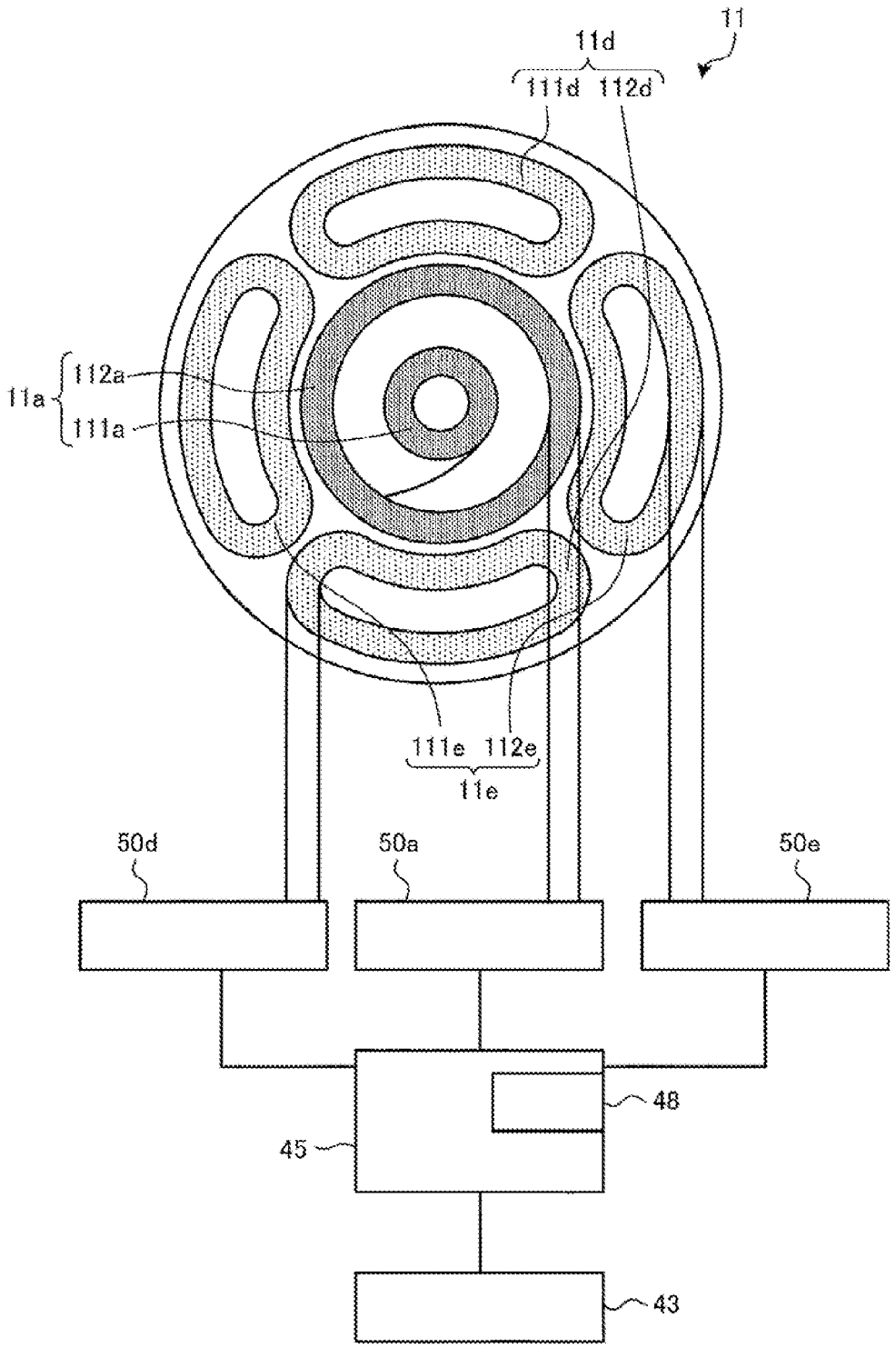
FIG. 3 is a block diagram illustrating the configuration of the induction heating cooker according to Embodiment 1.

FIG. 3 is a block diagram illustrating the configuration of the induction heating cooker according to Embodiment 1.

As illustrated in FIG. 3, the first induction heating unit 11 is driven and controlled by the driving circuit 50*a*, the driving circuit 50*d*, and the driving circuit 50*e*. That is, the inner periphery coil 11*a* is driven and controlled by the driving circuit 50*a*. In addition, the outer-periphery upper coil 111*d* and the outer-periphery lower coil 112*d* are driven and controlled by the driving circuit 50*d*. In addition, the outer-periphery left coil 111*e* and the outer-periphery right coil 112*e* are driven and controlled by the driving circuit 50*e*.

By supplying a high-frequency current from the driving circuit 50*a* to the inner periphery coil 11*a*, a high frequency magnetic field is generated from the inner periphery coil 11*a*. By supplying a high-frequency current from the driving circuit 50*d* to the outer-periphery upper coil 111*d* and the outer-periphery lower coil 112*d*, a high frequency magnetic field is generated from the outer-periphery upper coil 111*d* and the outer-periphery lower coil 112*d*. By supplying a high-frequency current from the driving circuit 50*e* to the outer-periphery left coil 111*e* and the outer-periphery right coil 112*e*, a high frequency magnetic field is generated from the outer-periphery left coil 111*e* and the outer-periphery right coil 112*e*.

The controller 45 is constituted by a dedicated hardware device or a central processing unit (CPU) that executes programs stored in a memory 48. Note that the CPU is also called a central processor, a processing unit, an arithmetic unit, a microprocessor, a microcomputer, or a processor.

In a case where the controller 45 is a dedicated hardware device, the controller 45 corresponds to, for example, a single circuit, a multiple circuit, an application specific integrated circuit (ASIC), a field-programmable gate array (FPGA), or a combination of these. Function units realized by the controller 45 may be realized by individual hardware devices, or the function units may also be realized by a single hardware device.

In a case where the controller 45 is a CPU, the functions executed by the controller 45 are realized by software, firmware, or a combination of software and firmware. The software or the firmware is described as programs and is stored in the memory 48. The CPU reads out and executes the programs stored in the memory 48 to realize the functions of the controller 45. In this case, the memory 48 is, for example, a nonvolatile or volatile semiconductor memory such as a random access memory (RAM), a read-only memory (ROM), a flash memory, an electrically programmable read-only memory (EPROM), or an electrically erasable programmable ROM (EEPROM).

Note that some of the functions of the controller 45 may be realized by a dedicated hardware device and some of the functions may be realized by software or firmware.

Figure 4:
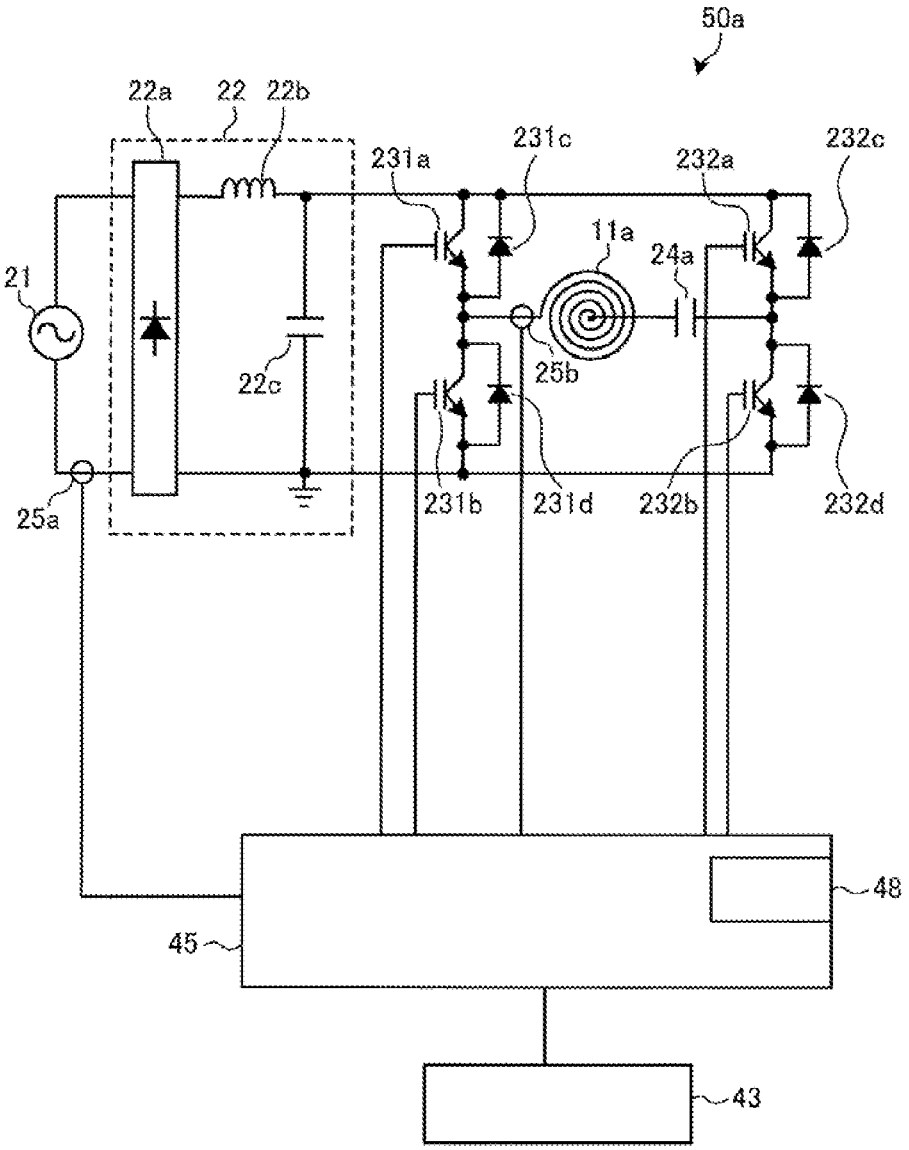
FIG. 4 is a diagram illustrating a driving circuit of the induction heating cooker according to Embodiment 1.

FIG. 4 is a diagram illustrating a driving circuit of the induction heating cooker according to Embodiment 1.

Note that the driving circuit 50 is provided on a heating unit basis, and the circuit configuration may be identical or may also be changed from heating unit to heating unit. FIG. 4 illustrates the driving circuit 50*a* for driving the inner periphery coil 11*a*.

As illustrated in FIG. 4, the driving circuit 50*a* is constituted by a full bridge inverter circuit having two pairs of arms. Each arm of the driving circuit 50*a* is constituted by two switching elements (IGBTs) connected in series between positive and negative bus bars and diodes connected in anti-parallel to the respective switching elements.

In addition, the driving circuit 50*a* includes a direct-current power supply circuit 22, a resonant capacitor 24*a*, and an input current detection unit 25*a*.

The input current detection unit 25*a* is constituted by, for example, a current sensor, detects a current input from an alternating-current power supply 21 to the direct-current power supply circuit 22, and outputs a voltage signal corresponding to the input current value to the controller 45.

The direct-current power supply circuit 22 includes a diode bridge 22*a*, a reactor 22*b*, and a smoothing capacitor 22*c*, and converts an alternating voltage input from the alternating-current power supply 21 into a direct-current voltage.

The two pairs of arms are connected between the positive and negative bus bars to which output is performed from the direct-current power supply circuit 22. In one of the arms, IGBTs 231*a* and 231*b*, which are switching elements, are connected in series and diodes 231*c* and 231*d*, which are flywheel diodes, are connected in parallel to the respective IGBTs 231*a* and 231*b*. In the other arm, IGBTs 232*a* and 232*b*, which are switching elements, are connected in series, and diodes 232*c* and 232*d*, which are flywheel diodes, are connected in parallel to the respective IGBTs 232*a* and 232*b*.

The IGBT 231*a*, the IGBT 231*b*, the IGBT 232*a*, and the IGBT 232*b* are driven on and off with a driving signal output from the controller 45. The controller 45 places the IGBT 231*b* in an off state while the IGBT 231*a* is on, places the IGBT 231*b* in an on state while the IGBT 231*a* is off, and outputs a driving signal for alternately performing switch-on and switch-off. In addition, the controller 45 places the IGBT 232*b* in an off state while the IGBT 232*a* is on, places the IGBT 232*b* in an on state while the IGBT 232*a* is off, and outputs a driving signal for alternately performing switch-on and switch-off.

As a result, the driving circuit 50*a* converts direct-current power output from the direct-current power supply circuit 22 into a high-frequency alternating-current power of about 20 kHz to 100 kHz, and supplies the power to a resonant circuit constituted by the inner periphery coil 11*a* and the resonant capacitor 24*a*.

With this configuration, a high-frequency current of about a few tens of amperes flows through the inner periphery coil 11*a*, and the high-frequency magnetic flux generated by the flowing high-frequency current causes the to-be-heated object 5 mounted on the top plate 4 directly above the inner periphery coil 11*a* to be induction heated.

Note that the IGBT 231*a*, the IGBT 231*b*, the IGBT 232*a*, and the IGBT 232*b*, which are switching elements, are configured using, for example, a silicon-based semiconductor. Note that they may also be configured using silicon carbide or a wide band gap semiconductor material such as a gallium nitride based material. By using a wide band gap semiconductor material for the switching elements, the loss at the switching elements can be reduced. In addition, heat dissipation from the driving circuit is preferably performed even when the switching frequency is high, and thus the heat dissipation fin of the driving circuit can be more compact, thereby realizing a reduction in the size and cost of the driving circuit.

A coil current detection unit 25*b* is connected to the resonant circuit constituted by the inner periphery coil 11*a* and the resonant capacitor 24*a*. The coil current detection unit 25*b* is constituted by, for example, a current sensor, detects a current flowing through the inner periphery coil 11*a*, and outputs a voltage signal corresponding to the coil current value to the controller 45.

Figure 5:
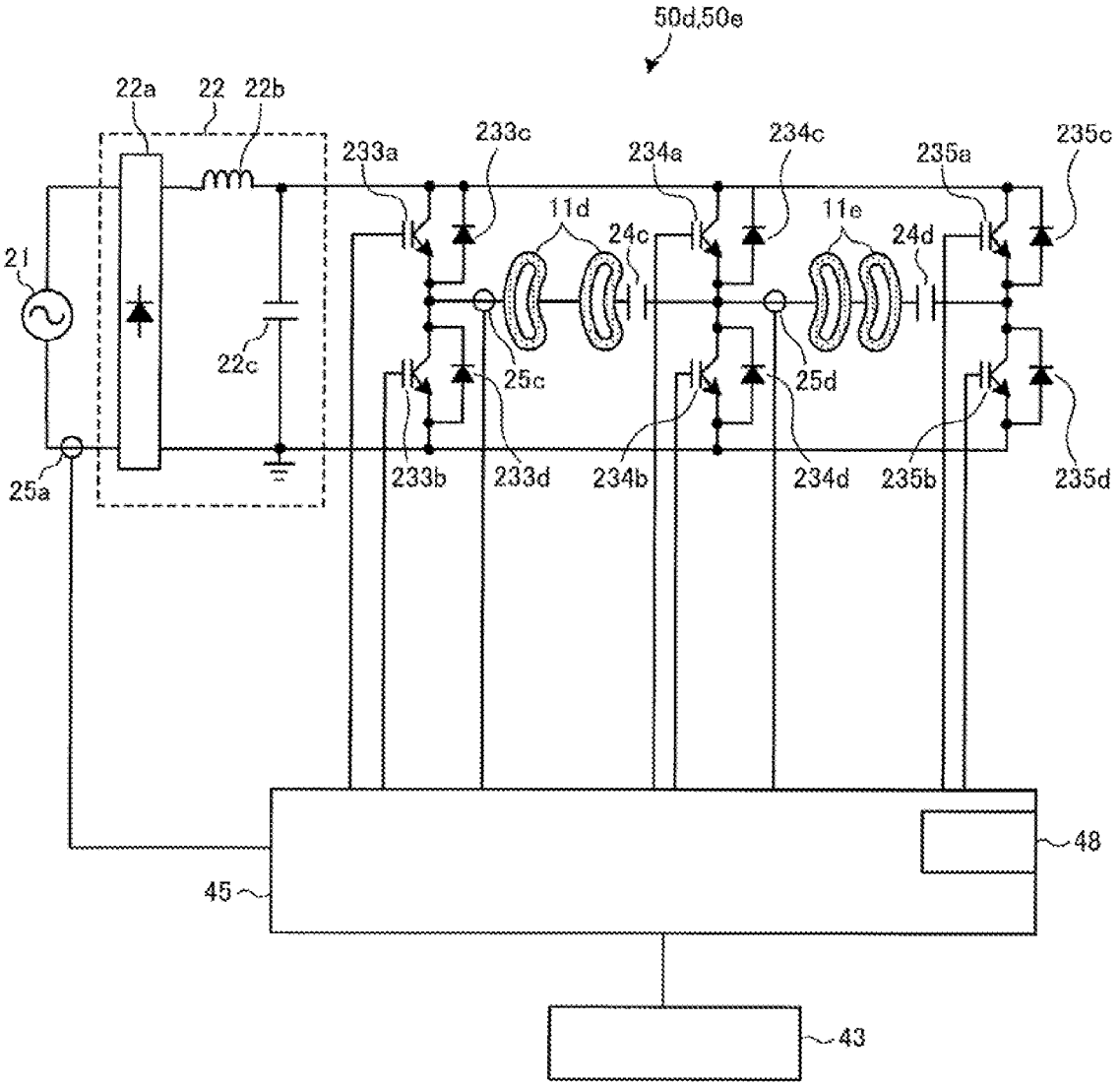
FIG. 5 is a diagram illustrating a driving circuit of the induction heating cooker according to Embodiment 1.

FIG. 5 is a diagram illustrating a driving circuit of the induction heating cooker according to Embodiment 1.

FIG. 5 illustrates the driving circuit 50*d* for driving the outer periphery coil 11*d*, and the driving circuit 50*e* for driving the outer periphery coil 11*e*.

As illustrated in FIG. 5, the driving circuit 50*d* and the driving circuit 50*e* include three pairs of arms constituted by two switching elements (IGBTs) connected in series between positive and negative bus bars and diodes connected in anti-parallel to the respective switching elements. Note that, hereinafter, one of the three pairs of arms is called a common arm, and the other two pairs are called a first arm and a second arm.

The common arm is an arm connected to the outer periphery coil 11*d* and the outer periphery coil 11*e*, and is constituted by an IGBT 234*a*, an IGBT 234*b*, a diode 234*c*, and a diode 234*d*.

The first arm is an arm to which the outer periphery coil 11*d* is connected, and is constituted by an IGBT 233*a*, an IGBT 233*b*, a diode 233*c*, and a diode 233*d*.

The second arm is an arm to which the outer periphery coil 11*e* is connected, and is constituted by an IGBT 235*a*, an IGBT 235*b*, a diode 235*c*, and a diode 235*d*.

The IGBT 234*a* and the IGBT 234*b* of the common arm, the IGBT 233*a* and the IGBT 233*b* of the first arm, and the IGBT 235*a* and the IGBT 235*b* of the second arm are driven on and off with a driving signal output from the controller 45.

The controller 45 places the IGBT 234*b* of the common arm in an off state while the IGBT 234*a* is on, places the IGBT 234*b* in an on state while the IGBT 234*a* is off, and outputs a driving signal for alternately performing switch-on and switch-off. Likewise, the controller 45 outputs a driving signal for alternately switching on and off the IGBT 233*a* and the IGBT 233*b* of the first arm and the IGBT 235*a* and the IGBT 235*b* of the second arm.

As a result, the common arm and the first arm constitute a full-bridge inverter for driving the outer periphery coil 11*d*. In addition, the common arm and the second arm constitute a full-bridge inverter for driving the outer periphery coil 11*e*.

A load circuit constituted by the outer periphery coil 11*d* and a resonant capacitor 24*c* is connected between a connection point that is an output point of the common arm and at which the IGBT 234*a* is connected to the IGBT 234*b* and a connecting point that is an output point of the first arm and at which the IGBT 233*a* is connected to the IGBT 233*b*.

A load circuit constituted by the outer periphery coil 11*e* and a resonant capacitor 24*d* is connected between the output point of the common arm and a connecting point that is an output point of the second arm and at which the IGBT 235*a* is connected to the IGBT 235*b*.

A coil current flowing through the outer periphery coil 11*d* is detected by a coil current detection unit 25*c*. The coil current detection unit 25*c* detects, for example, the peak of the current flowing through the outer periphery coil 11*d*, and outputs a voltage signal corresponding to a peak value of the heating coil current to the controller 45.

A coil current flowing through the outer periphery coil 11*e* is detected by a coil current detection unit 25*d*. The coil current detection unit 25*d* detects, for example, the peak of the current flowing through the outer periphery coil 11*e*, and outputs a voltage signal corresponding to a peak value of the heating coil current to the controller 45.

The controller 45 inputs a high-frequency driving signal to the switching elements (IGBTs) of each arm in accordance with input power and adjusts power to be supplied to each coil. The controller 45 causes the driving signals for the arms to have the same frequency and performs phase difference control on the driving signal for the first arm and the second arm with respect to the driving signal for the common arm to adjust power to be supplied to each coil. Note that the driving signals for the arms have the same on duty ratio.

In this manner, by sharing one of the arms of the two full bridge inverter circuits as the common arm, the number of parts of the inverters is reduced by reducing the number of IGBTs from eight to six, thereby achieving a low cost configuration.

Note that, in FIG. 5, the example has been illustrated in which the outer-periphery upper coil 111*d* and the outer-periphery lower coil 112*d*, which constitute the outer periphery coil 11*d*, are connected in series and the outer-periphery left coil 111*e* and the outer-periphery right coil 112*e*, which constitute the outer periphery coil 11*e*, are connected in series; however, the embodiment of the present invention is not limited to this. Needless to say, the four outer coils may also be driven by individual driving circuits.

Note that the inner periphery coil 11*a* corresponds to a "first coil" in the present invention.

In addition, the outer periphery coil 11*d* and the outer periphery coil 11*e* correspond to a "second coil" in the present invention.

In addition, the driving circuit 50*a* corresponds to a "first inverter circuit" in the present invention.

In addition, the driving circuit 50*d* and the driving circuit 50*e* correspond to a "second inverter circuit" in the present invention.

In addition, the controller 45 corresponds to a "controller" in the present invention.

In addition, the high-frequency current supplied from the driving circuit 50*a* to the inner periphery coil 11*a* corresponds to a "first high-frequency current" in the present invention.

In addition, the high-frequency current supplied from the driving circuit 50*d* to the outer periphery coil 11*d* corresponds to a "second high-frequency current" in the present invention.

In addition, the high-frequency current supplied from the driving circuit 50*e* to the outer periphery coil 11*e* corresponds to a "second high-frequency current" in the present invention.

Operation

Next, the operation of the induction heating cooker according to Embodiment 1 will be described.

The user mounts the to-be-heated object 5 on a heater area indication of the induction heating cooker 100, and performs an input operation for starting a heating operation using the operation display unit 43.

The controller 45 performs a heating operation for induction heating the to-be-heated object 5 by bringing each of the driving circuits 50*a*, 50*d*, and 50*e* into operation in accordance with the input operation. That is, a high-frequency current is supplied to each of the inner periphery coil 11*a*, the outer-periphery upper coil 111*d* and the outer-periphery lower coil 112*d* as well as the outer-periphery left coil 111*e* and the outer-periphery right coil 112*e*.

The controller 45 drives the driving circuits 50*a*, 50*d*, and 50*e* at the same frequency. The controller 45 drives the driving circuits 50*a*, 50*d*, and 50*e* within a range of from 20 kHz to 100 kHz, for example, at a frequency of 21 kHz. As a result, the to-be-heated object 5 arranged on the top plate 4 is heated through induction. Note that the controller 45 may determine whether the to-be-heated object 5 is mounted above each coil and stop driving coils that are in a no-load state in which no to-be-heated object 5 is mounted. For example, the controller 45 performs a load determination in accordance with a relationship between a coil current and an input current.

In addition, the controller 45 drives the driving circuits 50*a*, 50*d*, and 50*e* at the same frequency such that the directions of the high-frequency currents are the same in adjacent portions of the inner periphery coil 11*a* and the individual outer periphery coils. Note that, the direct-current power supply circuit 22, the controller 45, and the operation display unit 43 may be common or shared elements shared between the circuits of FIGS. 4 and 5.

Figure 6:
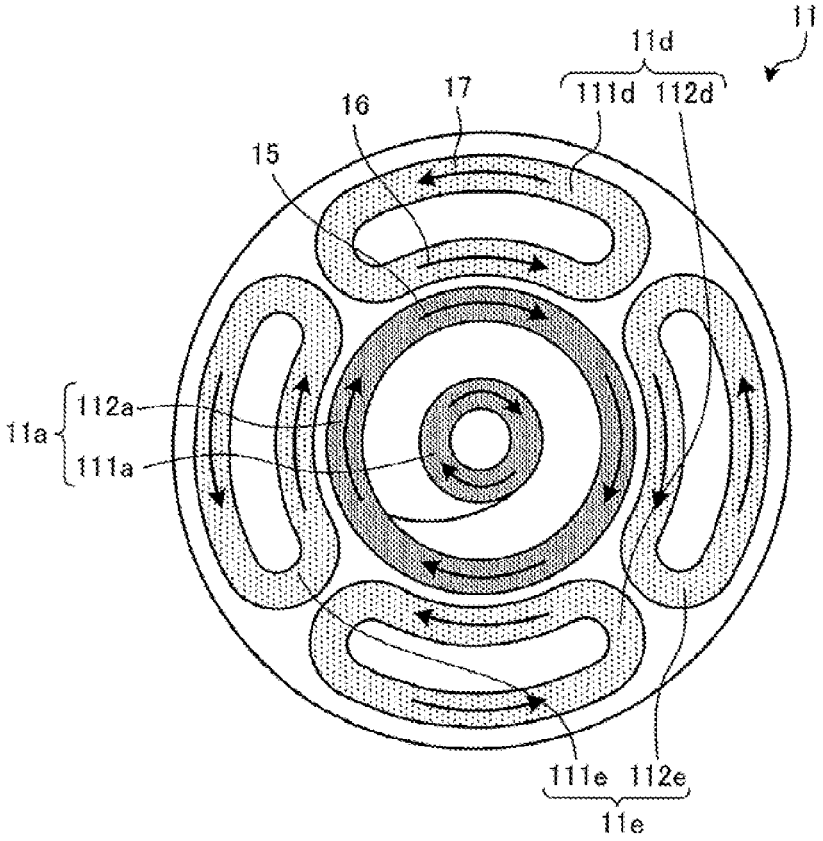
FIG. 6 is a diagram illustrating the direction of a current flowing through each coil of the induction heating cooker according to Embodiment 1.

FIG. 6 is a diagram illustrating the direction of a current flowing through each coil of the induction heating cooker according to Embodiment 1.

As illustrated in FIG. 6, a current direction 15 of the inner periphery coil 11*a* flows in the same direction as a direction 16 of a current flowing through portions of the individual outer periphery coils adjacent to the inner periphery coil 11*a*. In contrast, the current direction 15 of the inner periphery coil 11*a* flows in the opposite direction to a direction 17 of a current flowing through outer portions of the individual outer periphery coils.

The direction of a current flowing through each coil will be described in detail using FIG. 7. Note that since the individual outer periphery coils are configured the same, the outer-periphery right coil 112*e* will be described as an example.

Figure 7:
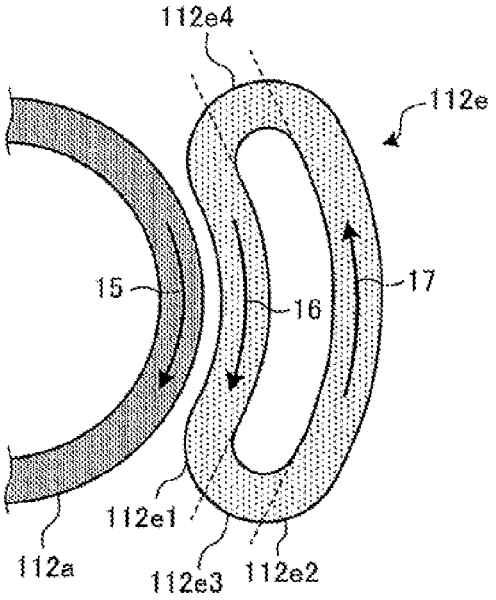
FIG. 7 is an enlarged view of a main portion illustrated in FIG. 6.

FIG. 7 is an enlarged view of a main portion illustrated in FIG. 6. Note that FIG. 7 illustrates a portion of the inner periphery coil 11*a* and the outer-periphery right coil 112*e*.

As illustrated in FIG. 7, the outer-periphery right coil 112*e* is formed of an annular coil obtained by performing winding. In addition, the outer-periphery right coil 112*e* has a first winding portion 112*e*1 extending in a circumferential direction of the inner periphery coil 11*a* and a second winding portion 112*e*2 spaced apart from the first winding portion 112*e*1 and extending in the circumferential direction of the inner periphery coil 11*a*. In addition, the outer-periphery right coil 112*e* has a third winding portion 112*e*3 and a fourth winding portion 112*e*4 between the first winding portion 112*e*1 and the second winding portion 112*e*2.

The current direction 16 of a high-frequency current flowing through the first winding portion 112*e*1 flows in the same direction as the current direction 15 of a high-frequency current flowing through the inner periphery coil 11*a* adjacent to the first winding portion 112*e*1.

As a result, the magnetic fields around the adjacent portions of the outer-periphery right coil 112*e* and the inner periphery coil 11*a* strengthen each other, and the amount of heat generated by induction heating can be increased. That is, heating at the corresponding portion can be intensified.

In contrast, the current direction 17 of the high-frequency current flowing through the second winding portion 112*e*2 flows in the opposite direction to the current direction 15 of the high-frequency current flowing through the inner periphery coil 11*a* adjacent to the first winding portion 112*e*1.

Thus, for example, when the first winding portion 112*e*1 and the second winding portion 112*e*2 are arranged on the same plane, a portion of the magnetic field generated by the high-frequency current flowing through the first winding portion 112*e*1 and a portion of the magnetic field generated by the high-frequency current flowing through the second winding portion 112*e*2 cancel each other out. That is, the amount of heat generated by induction heating the to-be-heated object 5 becomes small.

Thus, the induction heating cooker 100 according to Embodiment 1 is configured such that the distance between the first winding portion 112*e*1 of the individual outer periphery coil and the top plate 4 is different from the distance between the second winding portion 112*e*2 and the top plate 4. A specific example will be described using FIG. 8.

Coil Arrangement

Figure 8:
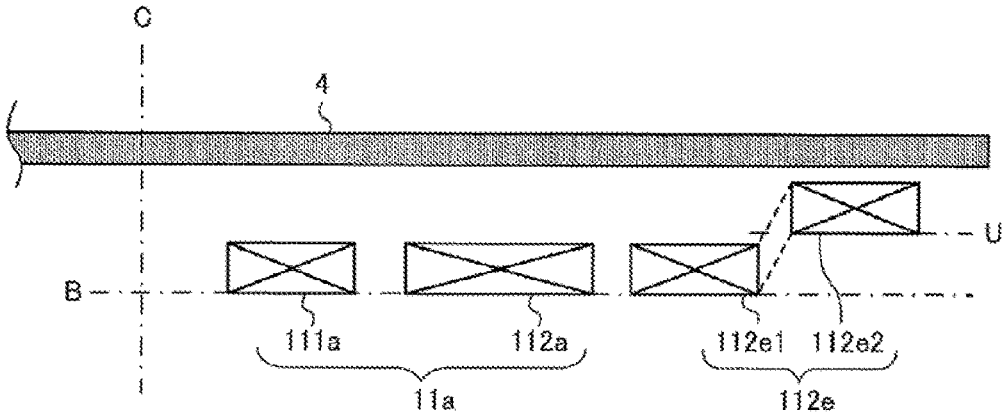
FIG. 8 is a cross section illustrating the arrangement of coils of the induction heating cooker according to Embodiment 1.

FIG. 8 is a cross section illustrating the arrangement of the coils of the induction heating cooker according to Embodiment 1.

Note that FIG. 8 schematically illustrates an X-X longitudinal section of FIG. 2. In addition, FIG. 8 illustrates only the right side of the heater area indication from the center C. Note that FIG. 8 illustrates the outer-periphery right coil 112*e* among the individual outer periphery coils; however, the other outer periphery coils are configured substantially the same.

As illustrated in FIG. 8, the inner periphery coil 11*a* and the first winding portion 112*e*1 of the outer-periphery right coil 112*e* are arranged on a reference plane B that is a plane parallel to the top plate 4. The second winding portion 112*e*2 of the outer-periphery right coil 112*e* is arranged on an upper plane U that is a plane parallel to the top plate 4 and located at a distance to the top plate 4, the distance being shorter than a distance from the reference plane B to the top plate 4. That is, the second winding portion 112*e*2 of the outer-periphery right coil 112*e* is located at a distance to the top plate 4, the distance being shorter than a distance from the first winding portion 112*e*1 to the top plate.

As described above, in Embodiment 1, the distance between the first winding portion 112*e*1 and the top plate 4 is different from the distance between the second winding portion 112*e*2 and the top plate 4.

Thus, when compared with the case where the first winding portion 112*e*1 and the second winding portion 112*e*2 are arranged on the same plane, it is possible to reduce the degree to which the magnetic field generated by the high-frequency current flowing through the first winding portion 112*e*1 and the magnetic field generated by the high-frequency current flowing through the second winding portion 112*e*2 cancel each other out. Thus, a reduction in heat at and the amount of heat generated at the outer periphery region of the to-be-heated object 5 can be suppressed, and the temperature irregularity at the outer periphery region of the to-be-heated object 5 can be reduced.

In particular, in a case where the distance between the inner side and the outer side corresponding to the width of the individual outer periphery coil is short, an advantageous effect in further reducing the temperature irregularity at the outer periphery region of the to-be-heated object 5 and an advantageous effect in further increasing heat at and the amount of heat generated at the outer periphery region of the to-be-heated object 5 can be obtained.

In addition, in Embodiment 1, the controller 45 drives the driving circuits 50*a*, 50*d*, and 50*e* at the same frequency. In addition, the high-frequency current flowing through the first winding portion of the individual outer periphery coil has the same direction as the high-frequency current flowing through the inner periphery coil 11*a* adjacent to the first winding portion.

Thus, the occurrence of noise due to magnetic interference can be suppressed by high-frequency currents having different frequencies flowing through the adjacent coils.

In addition, since the second winding portion 112*e*2 arranged on the outer periphery side of a heater area indication is arranged at a position closer to the top plate 4 than is the first winding portion 112*e*1, it is easier to heat the outer periphery region of the to-be-heated object 5 corresponding to the outer periphery side of the heater area indication, and an advantageous effect in reducing the temperature irregularity at the outer periphery region of the to-be-heated object 5, an example of which is a large pot, can be obtained. Thus, an advantageous effect in increasing heat at and the amount of heat generated at the outer periphery region of the to-be-heated object 5, an example of which is a large pot, can be obtained.

Embodiment 2

The arrangement of the individual outer periphery coils of an induction heating cooker 100 according to Embodiment 2 will be described mainly on the differences from Embodiment 1 described above.

Coil Arrangement

Figure 9:
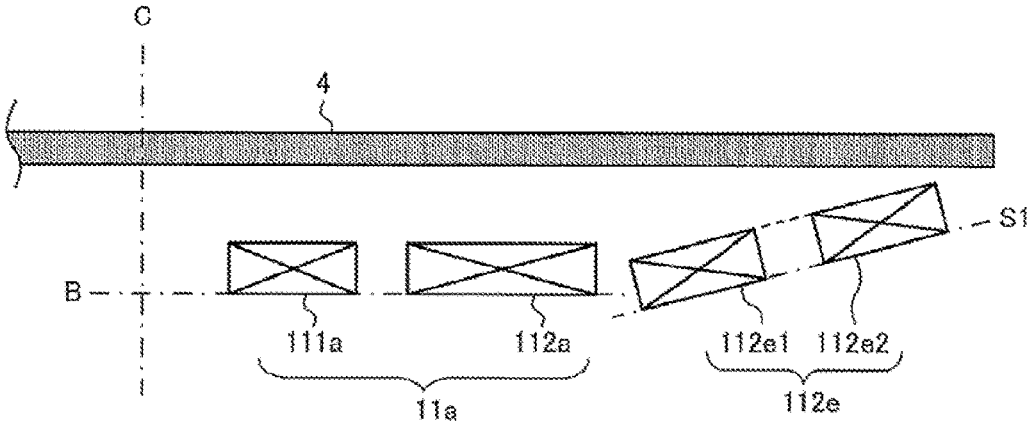
FIG. 9 is a cross section illustrating the arrangement of coils of an induction heating cooker according to Embodiment 2.

FIG. 9 is a cross section illustrating the arrangement of the coils of the induction heating cooker according to Embodiment 2.

Note that FIG. 9 schematically illustrates an X-X longitudinal section of FIG. 2. In addition, FIG. 9 illustrates only the right side of the heater area indication from the center C. Note that FIG. 9 illustrates the outer-periphery right coil 112*e* among the individual outer periphery coils; however, the other outer periphery coils are configured substantially the same.

As illustrated in FIG. 9, the inner periphery coil 11*a* and the first winding portion 112*e*1 of the outer-periphery right coil 112*e* are arranged on the reference plane B that is a plane parallel to the top plate 4. The outer-periphery right coil 112*e* is arranged on an upward inclined plane S1 that is inclined upward from the outer peripheral side of the inner periphery coil 11*a* toward the outer peripheral side of the heater area indication and that intersects the reference plane B. That is, the second winding portion 112*e*2 of the outer-periphery right coil 112*e* is located at a distance to the top plate 4, the distance being shorter than a distance from the first winding portion 112*e*1 to the top plate. In addition, both the first winding portion 112*e*1 and the second winding portion 112*e*2 of the outer-periphery right coil 112*e* are arranged obliquely with respect to the top plate 4.

With this configuration, substantially the same advantageous effects as those of Embodiment 1 described above can also be obtained. In addition, in Embodiment 2, since the first winding portion and the second winding portion of the individual outer periphery coil are arranged on the same plane, a coil bending process can be omitted in a manufacturing process of the individual outer periphery coil, and thus the manufacturing process can be simplified.

In addition, in Embodiment 2, compared with an outer periphery coil having the same coil width, the space between the first winding portion 112*e*1 and the second winding portion 112*e*2 can be widened. A specific example will be described using FIG. 10.

Figure 10:
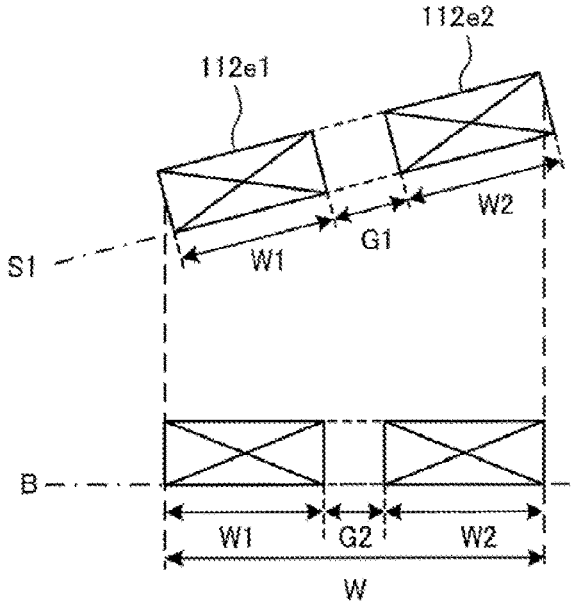
FIG. 10 is a diagram for describing the space between a first winding portion and a second winding portion of the induction heating cooker according to Embodiment 2.

FIG. 10 is a diagram for describing the space between the first winding portion and the second winding portion of the induction heating cooker according to Embodiment 2.

The lower part of FIG. 10 illustrates a configuration in which the outer-periphery right coil 112*e* is arranged on the reference plane B. In this case, a coil width Win a plan view is the sum of a width W1 of the first winding portion 112*e*1, a width W2 of the second winding portion 112*e*2, and a space G2.

The upper part of FIG. 10 illustrates a configuration in which the outer-periphery right coil 112*e* is arranged on the upward inclined plane S1. In a case where the same coil width W is used for the outer-periphery right coil 112*e* in a plan view, a space G1 between the first winding portion 112*e*1 and the second winding portion 112*e*2 arranged on the upward inclined plane S1 is wider than the space G2.

In this manner, with the configuration according to Embodiment 2, the space between the first winding portion 112*e*1 and the second winding portion 112*e*2 can be wider than in a case where the outer periphery coil having with the same coil width W is arranged on the reference plane B.

Modification 1

Figure 11:
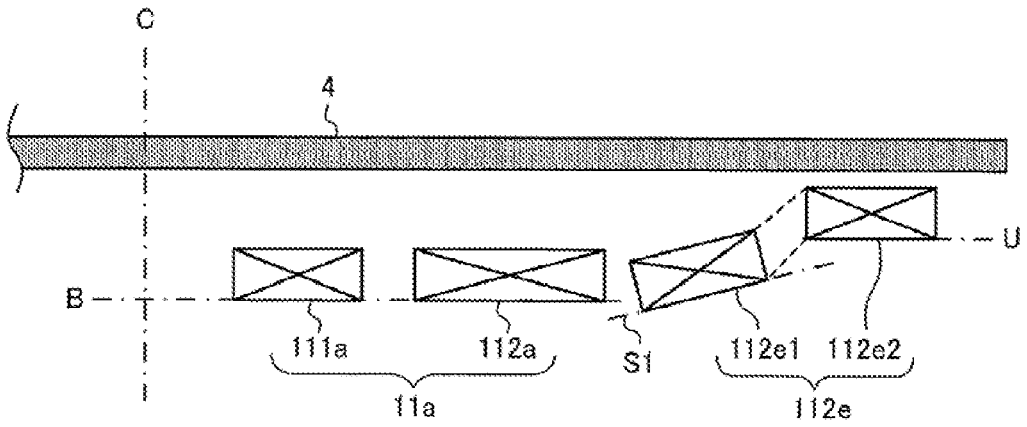
FIG. 11 is a cross section illustrating modification 1 of the arrangement of the coils of the induction heating cooker according to Embodiment 2.

FIG. 11 is a cross section illustrating modification 1 of the arrangement of the coils of the induction heating cooker according to Embodiment 2.

Note that FIG. 11 schematically illustrates the X-X longitudinal section of FIG. 2. In addition, FIG. 11 illustrates only the right side of the heater area indication from the center C. Note that FIG. 11 illustrates the outer-periphery right coil 112*e* among the individual outer periphery coils; however, the other outer periphery coils are configured substantially the same.

As illustrated in FIG. 11, the inner periphery coil 11*a* is arranged on the reference plane B that is a plane parallel to the top plate 4. The first winding portion 112*e*1 of the outer-periphery right coil 112*e* is arranged on an upward inclined plane S1 that is a plane inclined upward from the outer peripheral side of the inner periphery coil 11*a* toward the outer peripheral side of the heater area indication and intersecting the reference plane B. The second winding portion 112*e*2 of the outer-periphery right coil 112*e* is arranged on the upper plane U that is a plane parallel to the top plate 4 and located at a distance to the top plate 4, the distance being shorter than a distance from the reference plane B to the top plate 4. That is, the second winding portion 112*e*2 of the outer-periphery right coil 112*e* is located at a distance to the top plate 4, the distance being shorter than a distance from the first winding portion 112*e*1 to the top plate. In addition, the first winding portion 112*e*1 of the outer-periphery right coil 112*e* is arranged obliquely with respect to the top plate 4.

With this configuration, substantially the same advantageous effects as those of Embodiment 1 described above can also be obtained. In addition, compared with the configuration in Embodiment 1 described above, a coil bending amount can be reduced for the individual outer periphery coil, and thus the manufacturing can be easily performed.

Modification 2

Figure 12:
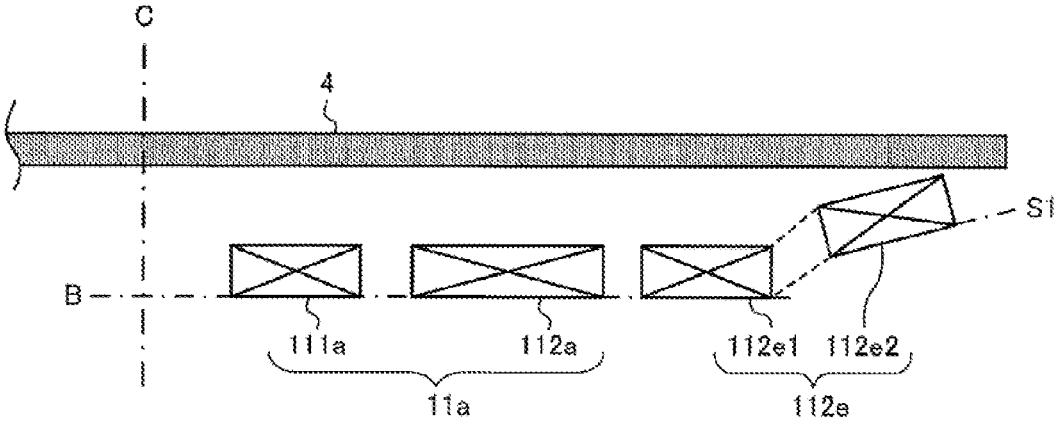
FIG. 12 is a cross section illustrating modification 2 of the arrangement of the coils of the induction heating cooker according to Embodiment 2.

FIG. 12 is a cross section illustrating modification 2 of the arrangement of the coils of the induction heating cooker according to Embodiment 2.

Note that FIG. 12 schematically illustrates the X-X longitudinal section of FIG. 2. In addition, FIG. 12 illustrates only the right side of the heater area indication from the center C. Note that FIG. 12 illustrates the outer-periphery right coil 112*e* among the individual outer periphery coils; however, the other outer periphery coils are configured substantially the same.

As illustrated in FIG. 12, the inner periphery coil 11*a* and the first winding portion 112*e*1 of the outer-periphery right coil 112*e* are arranged on the reference plane B that is a plane parallel to the top plate 4. The second winding portion 112*e*2 of the outer-periphery right coil 112*e* is arranged on the upward inclined plane S1 that is a plane inclined upward from the outer peripheral side of the inner periphery coil 11*a* toward the outer peripheral side of the heater area indication and intersecting the reference plane B. That is, the second winding portion 112*e*2 of the outer-periphery right coil 112*e* is located at a distance to the top plate 4, the distance being shorter than a distance from the first winding portion 112*e*1 to the top plate. In addition, the second winding portion 112*e*2 of the outer-periphery right coil 112*e* is arranged obliquely with respect to the top plate 4.

With this configuration, substantially the same advantageous effects as those of Embodiment 1 described above can also be obtained. In addition, compared with the configuration in Embodiment 1 described above, the coil bending amount can be reduced in a manufacturing process for bending the outer periphery coil, and thus the manufacturing can be easily performed.

Embodiment 3

The arrangement of the individual outer periphery coils of an induction heating cooker 100 according to Embodiment 3 will be described mainly on the differences from Embodiments 1 and 2 described above.

Coil Arrangement

Figure 13:
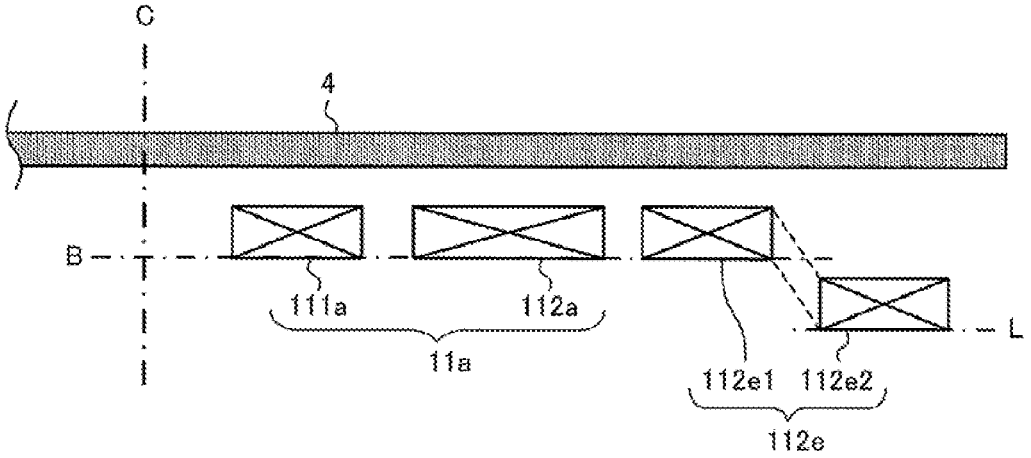
FIG. 13 is a cross section illustrating the arrangement of coils of an induction heating cooker according to Embodiment 3.

FIG. 13 is a cross section illustrating the arrangement of the coils of the induction heating cooker according to Embodiment 3.

Note that FIG. 13 schematically illustrates the X-X longitudinal section of FIG. 2. In addition, FIG. 13 illustrates only the right side of the heater area indication from the center C. Note that FIG. 13 illustrates the outer-periphery right coil 112*e* among the individual outer periphery coils; however, the other outer periphery coils are configured substantially the same.

As illustrated in FIG. 13, the inner periphery coil 11*a* and the first winding portion 112*e*1 of the outer-periphery right coil 112*e* are arranged on the reference plane B that is a plane parallel to the top plate 4. The second winding portion 112*e*2 of the outer-periphery right coil 112*e* is arranged on a lower plane L that is a plane parallel to the top plate 4 and located at a distance to the top plate 4, the distance being longer than a distance from the reference plane B to the top plate 4. That is, the second winding portion 112*e*2 of the outer-periphery right coil 112*e* is located at a distance to the top plate 4, the distance being longer than a distance from the first winding portion 112*e*1 to the top plate.

As described above, in Embodiment 3, the distance between the first winding portion 112*e*1 and the top plate 4 is different from the distance between the second winding portion 112*e*2 and the top plate 4.

Thus, when compared with the case where the first winding portion 112*e*1 and the second winding portion 112*e*2 are arranged on the same plane, it is possible to reduce the degree to which the magnetic field generated by the high-frequency current flowing through the first winding portion 112*e*1 and the magnetic field generated by the high-frequency current flowing through the second winding portion 112*e*2 cancel each other out. Thus, a reduction in heat at and the amount of heat generated at the outer periphery region of the to-be-heated object 5 can be suppressed, and the temperature irregularity at the outer periphery region of the to-be-heated object 5 can be reduced.

In particular, in a case where the distance between the inner side and the outer side corresponding to the width of the individual outer periphery coil is short, an advantageous effect in further reducing the temperature irregularity at the outer periphery region of the to-be-heated object 5 and an advantageous effect in further increasing heat at and the amount of heat generated at the outer periphery region of the to-be-heated object 5 can be obtained.

In addition, in Embodiment 3, the controller 45 drives the driving circuits 50*a*, 50*d*, and 50*e* at the same frequency. In addition, the high-frequency current flowing through the first winding portion of the individual outer periphery coil has the same direction as the high-frequency current flowing through the inner periphery coil 11*a* adjacent to the first winding portion.

Thus, the occurrence of noise due to magnetic interference can be suppressed by high-frequency currents having different frequencies flowing through the adjacent coils.

In addition, the first winding portion 112*e*1 arranged on the inner periphery side of the heater area indication is arranged at a position closer to the top plate 4 than the second winding portion 112*e*2. Thus, it is easier to heat the central portion of the to-be-heated object 5 corresponding to the inner periphery side of the heater area indication, and an advantageous effect in reducing the temperature irregularity at the outer periphery region of the to-be-heated object 5, an example of which is a medium pot or a small pot, can be obtained. Generally a large number of medium pots and small pots are diffused. Thus, an advantageous effect in increasing heat at and the amount of heat generated at the outer periphery region of the to-be-heated object 5, an example of which is a medium pot or a small pot, can be obtained.

Modification 1

Figure 14:
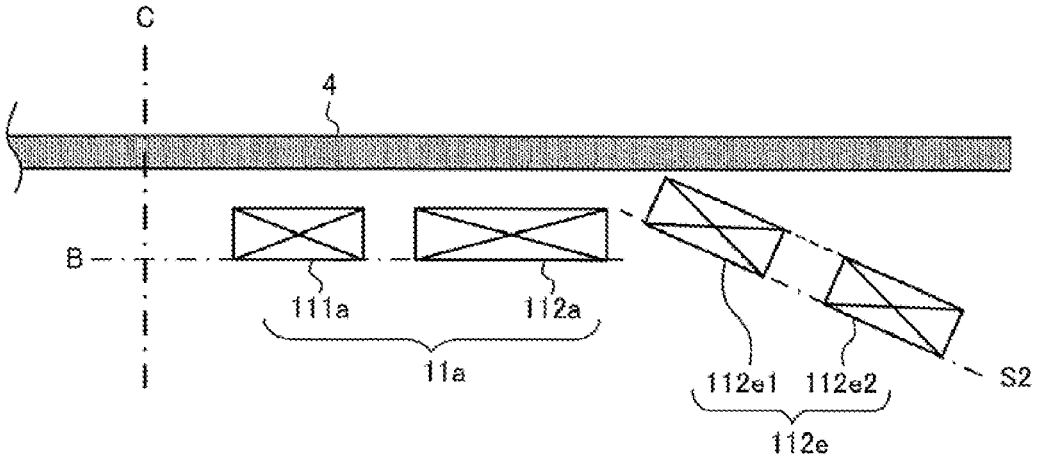
FIG. 14 is a cross section illustrating modification 1 of the arrangement of the coils of the induction heating cooker according to Embodiment 3.

FIG. 14 is a cross section illustrating modification 1 of the arrangement of the coils of the induction heating cooker according to Embodiment 3.

Note that FIG. 14 schematically illustrates the X-X longitudinal section of FIG. 2. In addition, FIG. 14 illustrates only the right side of the heater area indication from the center C. Note that FIG. 14 illustrates the outer-periphery right coil 112*e* among the individual outer periphery coils; however, the other outer periphery coils are configured substantially the same.

As illustrated in FIG. 14, the inner periphery coil 11*a* is arranged on the reference plane B that is a plane parallel to the top plate 4. The outer-periphery right coil 112*e* is arranged on a downward inclined plane S2 that is inclined downward from the outer peripheral side of the inner periphery coil 11*a* toward the outer peripheral side of the heater area indication and that intersects the reference plane B. That is, the first winding portion 112*e*1 of the outer-periphery right coil 112*e* is located at a distance to the top plate 4, the distance being shorter than a distance from the second winding portion 112*e*2 to the top plate. In addition, both the first winding portion 112*e*1 and the second winding portion 112*e*2 of the outer-periphery right coil 112*e* are arranged obliquely with respect to the top plate 4.

With this configuration, the above-described advantageous effects can also be obtained. In addition, since the first winding portion and the second winding portion of the individual outer periphery coil are arranged on the same plane, the coil bending process can be omitted in the manufacturing process of the individual outer periphery coil, and thus the manufacturing process can be simplified.

In addition, similarly to as in Embodiment 2 described above, compared with an outer periphery coil having the same coil width, the space between the first winding portion 112*e*1 and the second winding portion 112*e*2 can be widened.

Modification 2

Figure 15:
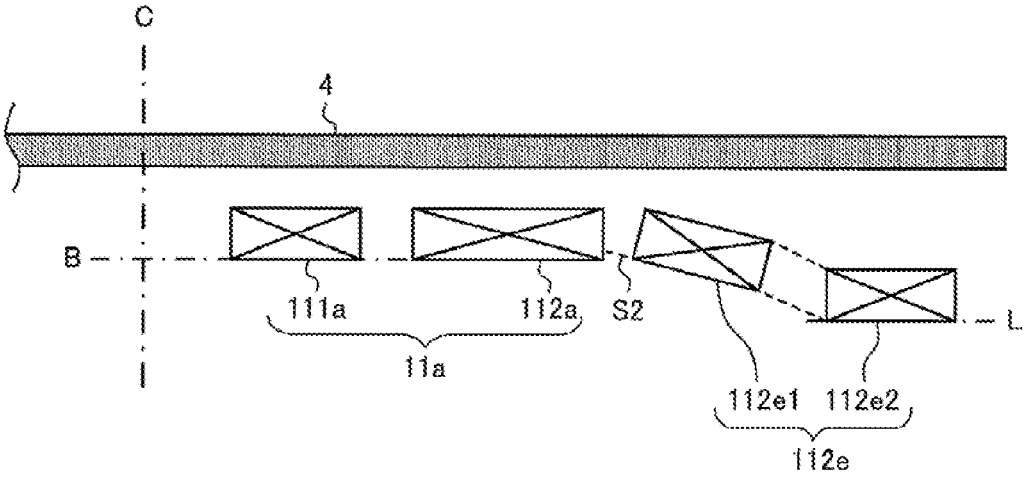
FIG. 15 is a cross section illustrating modification 2 of the arrangement of the coils of the induction heating cooker according to Embodiment 3.

FIG. 15 is a cross section illustrating modification 2 of the arrangement of the coils of the induction heating cooker according to Embodiment 3.

Note that FIG. 15 schematically illustrates the X-X longitudinal section of FIG. 2. In addition, FIG. 15 illustrates only the right side of the heater area indication from the center C. Note that FIG. 15 illustrates the outer-periphery right coil 112*e* among the individual outer periphery coils; however, the other outer periphery coils are configured substantially the same.

As illustrated in FIG. 15, the inner periphery coil 11*a* is arranged on the reference plane B that is a plane parallel to the top plate 4. The first winding portion 112*e*1 of the outer-periphery right coil 112*e* is arranged on the downward inclined plane S2 that is a plane inclined downward from the outer peripheral side of the inner periphery coil 11*a* toward the outer peripheral side of the heater area indication and intersecting the reference plane B. The second winding portion 112*e*2 of the outer-periphery right coil 112*e* is arranged on the lower plane L that is a plane parallel to the top plate 4 and located at a distance to the top plate 4, the distance being longer than a distance from the reference plane B to the top plate 4. That is, the first winding portion 112*e*1 of the outer-periphery right coil 112*e* is located at a distance to the top plate 4, the distance being shorter than a distance from the second winding portion 112*e*2 to the top plate. In addition, the first winding portion 112*e*1 of the outer-periphery right coil 112*e* is arranged obliquely with respect to the top plate 4.

With this configuration, the above-described advantageous effects can also be obtained. In addition, compared with the configuration illustrated in FIG. 13, the coil bending amount can be reduced for the individual outer periphery coil, and thus the manufacturing can be easily performed.

Modification 3

Figure 16:
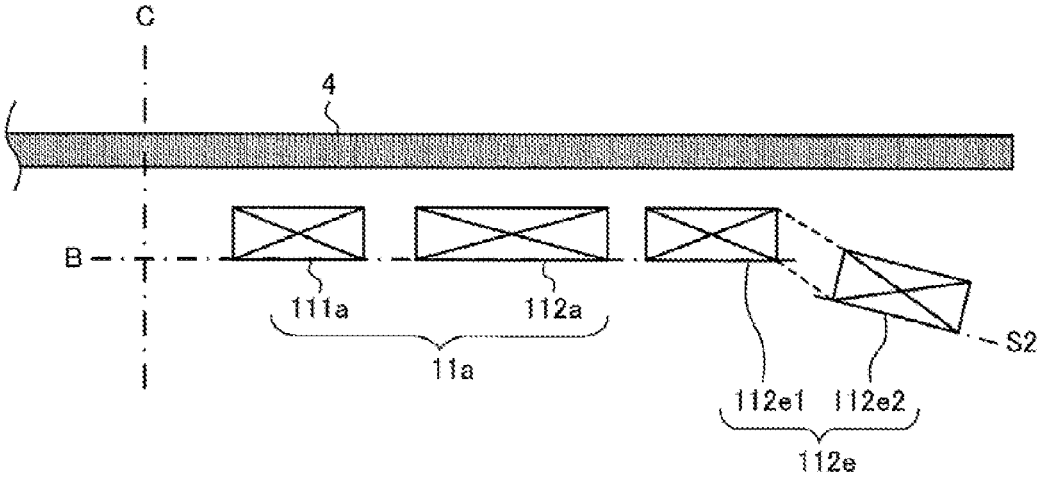
FIG. 16 is a cross section illustrating modification 3 of the arrangement of the coils of the induction heating cooker according to Embodiment 3.

FIG. 16 is a cross section illustrating modification 3 of the arrangement of the coils of the induction heating cooker according to Embodiment 3.

Note that FIG. 16 schematically illustrates the X-X longitudinal section of FIG. 2. In addition, FIG. 16 illustrates only the right side of the heater area indication from the center C. Note that FIG. 16 illustrates the outer-periphery right coil 112*e* among the individual outer periphery coils; however, the other outer periphery coils are configured substantially the same.

As illustrated in FIG. 16, the inner periphery coil 11*a* and the first winding portion 112*e*1 of the outer-periphery right coil 112*e* are arranged on the reference plane B that is a plane parallel to the top plate 4. The second winding portion 112*e*2 of the outer-periphery right coil 112*e* is arranged on the downward inclined plane S2 that is a plane inclined downward from the outer peripheral side of the inner periphery coil 11*a* toward the outer peripheral side of the heater area indication and intersecting the reference plane B. That is, the first winding portion 112*e*1 of the outer-periphery right coil 112*e* is located at a distance to the top plate 4, the distance being shorter than a distance from the second winding portion 112*e*2 to the top plate. In addition, the second winding portion 112*e*2 of the outer-periphery right coil 112*e* is arranged obliquely with respect to the top plate 4.

With this configuration, the above-described advantageous effects can also be obtained. In addition, compared with the configuration illustrated in FIG. 13, the coil bending amount can be reduced for the individual outer periphery coil, and thus the manufacturing can be easily performed.

Embodiment 4

The arrangement of the individual outer periphery coils of an induction heating cooker 100 according to Embodiment 4 will be described mainly on the differences from Embodiments 1 to 3 described above.

Coil Arrangement

An individual outer periphery coil among the individual outer periphery coils according to Embodiment 4 is arranged such that, in a plan view, at least a portion of the first winding portion is at a position superposed with the inner periphery coil 11*a*. A specific example will be described using FIG. 17.

Figure 17:
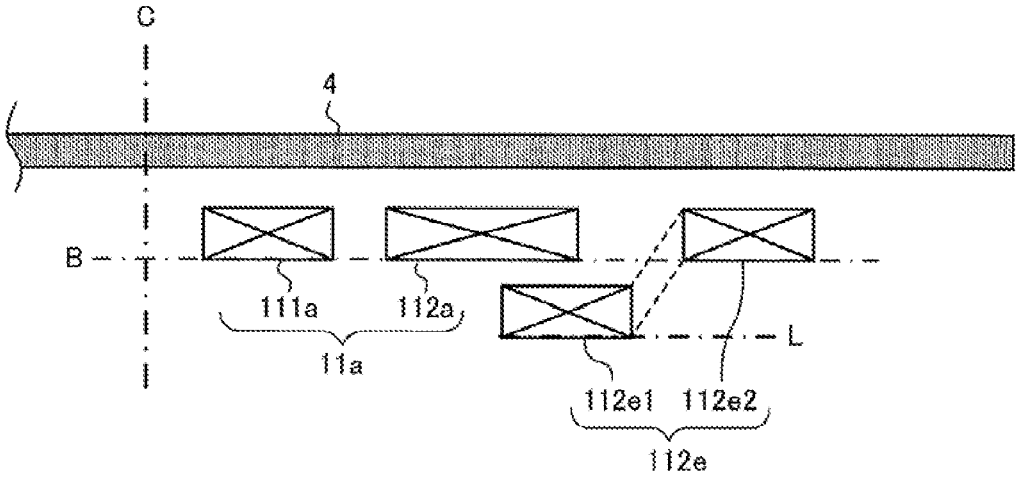
FIG. 17 is a cross section illustrating the arrangement of coils of an induction heating cooker according to Embodiment 4.

FIG. 17 is a cross section illustrating the arrangement of the coils of the induction heating cooker according to Embodiment 4.

Note that FIG. 17 schematically illustrates the X-X longitudinal section of FIG. 2. In addition, FIG. 17 illustrates only the right side of the heater area indication from the center C. Note that FIG. 17 illustrates the outer-periphery right coil 112*e* among the individual outer periphery coils; however, the other outer periphery coils are configured substantially the same.

As illustrated in FIG. 17, the inner periphery coil 11*a* and the second winding portion 112*e*2 of the outer-periphery right coil 112*e* are arranged on the reference plane B that is a plane parallel to the top plate 4. The first winding portion 112*e*1 of the outer-periphery right coil 112*e* is arranged on the lower plane L that is a plane parallel to the top plate 4 and located at a distance to the top plate 4, the distance being longer than a distance from the reference plane B to the top plate 4. That is, the first winding portion 112*e*1 of the outer-periphery right coil 112*e* is located at a distance to the top plate 4, the distance being longer than a distance from the second winding portion 112*e*2 to the top plate 4. In addition, in a plan view, at least a portion of the first winding portion 112*e*1 is arranged at a position underlying the inner periphery coil 11*a*.

As described above, in Embodiment 3, the distance between the first winding portion 112*e*1 and the top plate 4 is different from the distance between the second winding portion 112*e*2 and the top plate 4.

Thus, when compared with the case where the first winding portion 112*e*1 and the second winding portion 112*e*2 are arranged on the same plane, it is possible to reduce the degree to which the magnetic field generated by the high-frequency current flowing through the first winding portion 112*e*1 and the magnetic field generated by the high-frequency current flowing through the second winding portion 112*e*2 cancel each other out. Thus, a reduction in heat at and the amount of heat generated at the outer periphery region of the to-be-heated object 5 can be suppressed, and the temperature irregularity at the outer periphery region of the to-be-heated object 5 can be reduced.

In particular, in a case where the distance between the inner side and the outer side corresponding to the width of the individual outer periphery coil is short, an advantageous effect in further reducing the temperature irregularity at the outer periphery region of the to-be-heated object 5 and an advantageous effect in further increasing heat at and the amount of heat generated at the outer periphery region of the to-be-heated object 5 can be obtained.

In addition, in Embodiment 4, the controller 45 drives the driving circuits 50*a*, 50*d*, and 50*e* at the same frequency. In addition, the high-frequency current flowing through the first winding portion of the individual outer periphery coil has the same direction as the high-frequency current flowing through the inner periphery coil 11*a* adjacent to the first winding portion.

Thus, the occurrence of noise due to magnetic interference can be suppressed by high-frequency currents having different frequencies flowing through the adjacent coils.

In addition, the individual outer periphery coil according to Embodiment 4 is arranged such that, in a plan view, at least a portion of the first winding portion is at a position superposed with the inner periphery coil 11*a*. Thus, the magnetic field near the outer peripheral side of the inner periphery coil 11*a* can be strengthened. Thus, it is easier to heat the central portion of the to-be-heated object 5 corresponding to the inner periphery side of the heater area indication, and, regarding the to-be-heated object 5, an example of which is a medium pot or a small pot, the amount of heat generated at the outer periphery portion of the to-be-heated object 5 where the temperature tends to be on the lower side can be increased. Generally a large number of medium pots and small pots are diffused.

Modification 1

Figure 18:
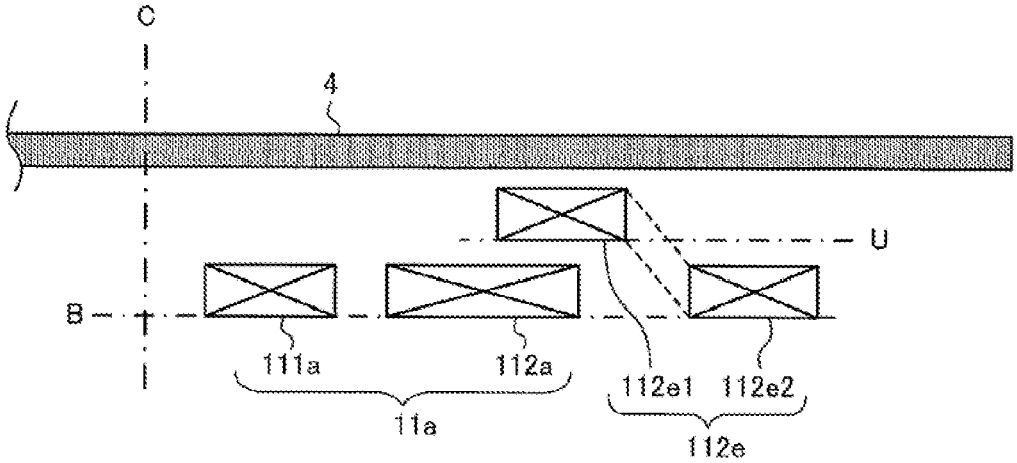
FIG. 18 is a cross section illustrating modification 1 of the arrangement of the coils of the induction heating cooker according to Embodiment 4.

FIG. 18 is a cross section illustrating modification 1 of the arrangement of the coils of the induction heating cooker according to Embodiment 4.

Note that FIG. 18 schematically illustrates the X-X longitudinal section of FIG. 2. In addition, FIG. 18 illustrates only the right side of the heater area indication from the center C. Note that FIG. 18 illustrates the outer-periphery right coil 112*e* among the individual outer periphery coils; however, the other outer periphery coils are configured substantially the same.

As illustrated in FIG. 18, the inner periphery coil 11*a* and the second winding portion 112*e*2 of the outer-periphery right coil 112*e* are arranged on the reference plane B that is a plane parallel to the top plate 4. The first winding portion 112*e*1 of the outer-periphery right coil 112*e* is arranged on the upper plane U that is a plane parallel to the top plate 4 and located at a distance to the top plate 4, the distance being shorter than a distance from the reference plane B to the top plate 4. That is, the first winding portion 112*e*1 of the outer-periphery right coil 112*e* is located at a distance to the top plate 4, the distance being shorter than a distance from the second winding portion 112*e*2 to the top plate. In addition, in a plan view, at least a portion of the first winding portion 112*e*1 is arranged at a position overlying the inner periphery coil 11*a*.

With this configuration, the above-described advantageous effects can also be obtained.

Modification 2

Figure 19:
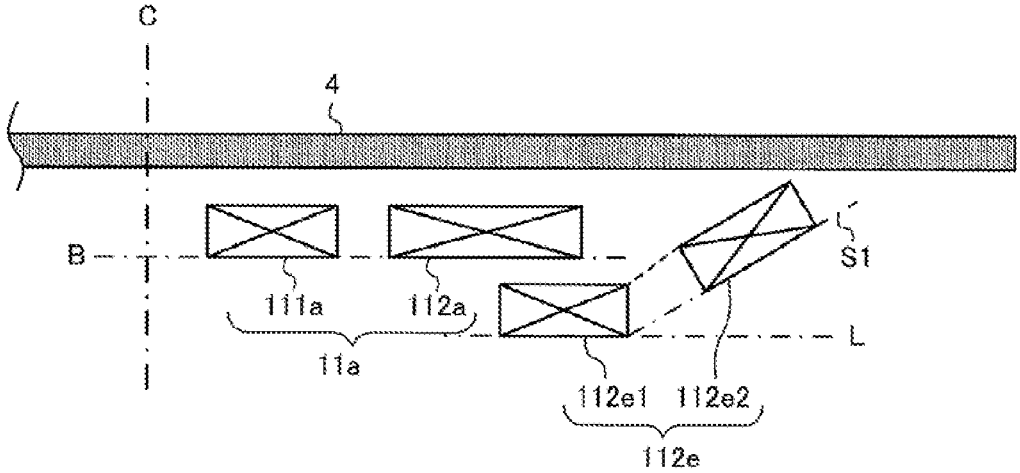
FIG. 19 is a cross section illustrating modification 2 of the arrangement of the coils of the induction heating cooker according to Embodiment 4.

FIG. 19 is a cross section illustrating modification 2 of the arrangement of the coils of the induction heating cooker according to Embodiment 4.

Note that FIG. 19 schematically illustrates the X-X longitudinal section of FIG. 2. In addition, FIG. 19 illustrates only the right side of the heater area indication from the center C. Note that FIG. 19 illustrates the outer-periphery right coil 112*e* among the individual outer periphery coils; however, the other outer periphery coils are configured substantially the same.

As illustrated in FIG. 19, the inner periphery coil 11*a* is arranged on the reference plane B that is a plane parallel to the top plate 4. The first winding portion 112*e*1 of the outer-periphery right coil 112*e* is arranged on the lower plane L that is a plane parallel to the top plate 4 and located at a distance to the top plate 4, the distance being longer than a distance from the reference plane B to the top plate 4. The second winding portion 112*e*2 of the outer-periphery right coil 112*e* is arranged on the upward inclined plane S1 that is a plane inclined upward from the outer peripheral side of the inner periphery coil 11*a* toward the outer peripheral side of the heater area indication and intersecting the reference plane B. That is, the first winding portion 112*e*1 of the outer-periphery right coil 112*e* is located at a distance to the top plate 4, the distance being longer than a distance from the second winding portion 112*e*2 to the top plate. In addition, the second winding portion 112*e*2 of the outer-periphery right coil 112*e* is arranged obliquely with respect to the top plate 4.

With this configuration, the above-described advantageous effects can also be obtained. In addition, compared with the configuration illustrated in FIG. 18, the coil bending amount can be reduced for the individual outer periphery coil, and thus the manufacturing can be easily performed.

Modification 3

Figure 20:
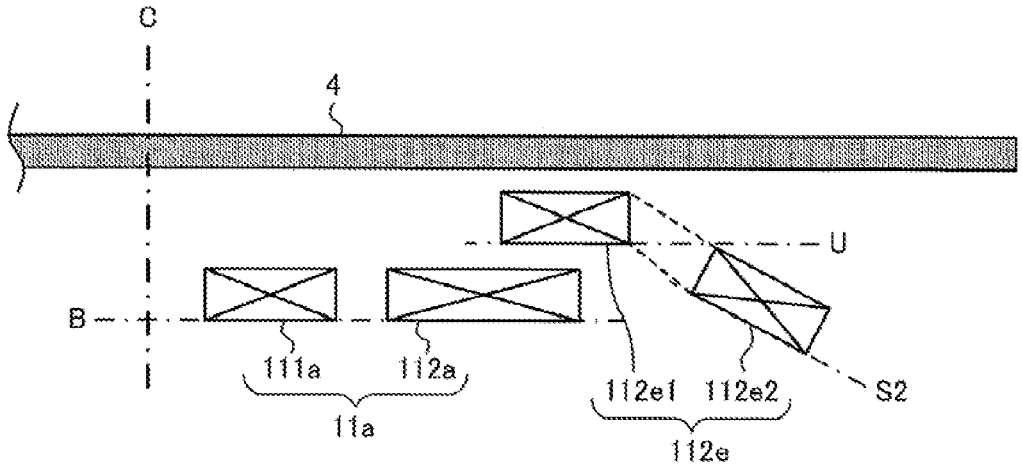
FIG. 20 is a cross section illustrating modification 3 of the arrangement of the coils of the induction heating cooker according to Embodiment 4.

FIG. 20 is a cross section illustrating modification 3 of the arrangement of the coils of the induction heating cooker according to Embodiment 4.

Note that FIG. 20 schematically illustrates the X-X longitudinal section of FIG. 2. In addition, FIG. 20 illustrates only the right side of the heater area indication from the center C. Note that FIG. 20 illustrates the outer-periphery right coil 112*e* among the individual outer periphery coils; however, the other outer periphery coils are configured substantially the same.

As illustrated in FIG. 20, the inner periphery coil 11*a* is arranged on the reference plane B that is a plane parallel to the top plate 4. The first winding portion 112*e*1 of the outer-periphery right coil 112*e* is arranged on the upper plane U that is a plane parallel to the top plate 4 and located at a distance to the top plate 4, the distance being shorter than a distance from the reference plane B to the top plate 4. The second winding portion 112*e*2 of the outer-periphery right coil 112*e* is arranged on the downward inclined plane S2 that is a plane inclined downward from the outer peripheral side of the inner periphery coil 11*a* toward the outer peripheral side of the heater area indication and intersecting the reference plane B. That is, the first winding portion 112*e*1 of the outer-periphery right coil 112*e* is located at a distance to the top plate 4, the distance being shorter than a distance from the second winding portion 112*e*2 to the top plate. In addition, the second winding portion 112*e*2 of the outer-periphery right coil 112*e* is arranged obliquely with respect to the top plate 4.

With this configuration, the above-described advantageous effects can also be obtained. In addition, compared with the configuration illustrated in FIG. 13, the coil bending amount can be reduced for the individual outer periphery coil, and thus the manufacturing can be easily performed.

Embodiment 5

The configuration of an induction heating cooker 100 according to Embodiment 5 will be described mainly on the differences from Embodiments 1 to 4 described above. Note that the arrangement of the individual outer periphery coils is the same as any of those in Embodiments 1 to 4 described above.

Figure 21:
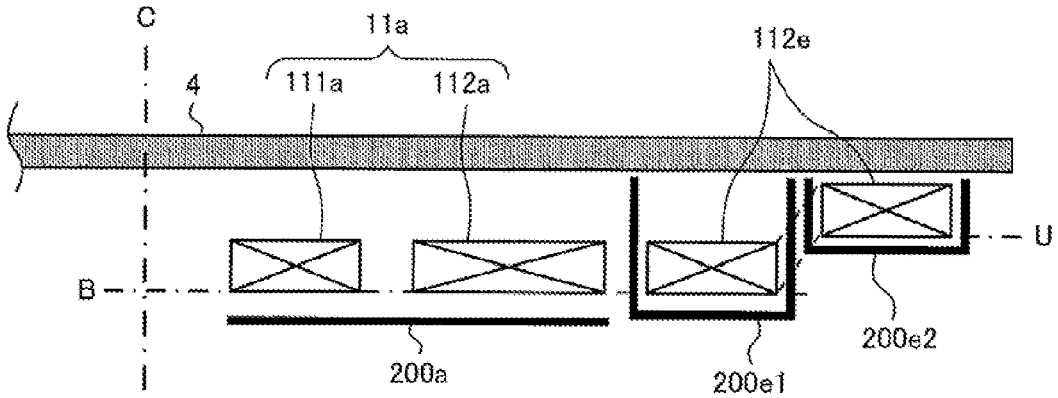
FIG. 21 is a cross section illustrating the arrangement of coils of an induction heating cooker according to Embodiment 5.

FIG. 21 is a cross section illustrating the arrangement of the coils of the induction heating cooker according to Embodiment 5.

Note that FIG. 21 schematically illustrates the X-X longitudinal section of FIG. 2. In addition, FIG. 21 illustrates only the right side of the heater area indication from the center C. Note that FIG. 21 illustrates the outer-periphery right coil 112*e* among the individual outer periphery coils; however, the other outer periphery coils are configured substantially the same.

As illustrated in FIG. 21, the induction heating cooker 100 according to Embodiment 5 includes a flat plate-shaped magnetic member 200*a* arranged radially below the inner periphery coil 11*a* in a plan view. The magnetic member 200*a* is formed of, for example, a magnetic material such as ferrite.

In addition, the induction heating cooker 100 includes a first magnetic member 200*e*1 arranged to surround at least a portion of both side surfaces and the bottom of the first winding portion 112*e*1 of the outer-periphery right coil 112*e*. In addition, the induction heating cooker 100 includes a second magnetic member 200*e*2 arranged to surround at least portion of both side surfaces and the bottom of the second winding portion 112*e*2 of the outer-periphery right coil 112*e*. The first magnetic member 200*e*1 and the second magnetic member 200*e*2 are each formed of a U-shaped magnetic material. The first magnetic member 200*e*1 and the second magnetic member 200*e*2 are formed of, for example, a magnetic material such as ferrite.

For example, as illustrated in FIG. 21, the top ends of the first magnetic member 200*e*1 and second magnetic member 200*e*2 are formed to be arranged at positions above the top ends of the outer-periphery right coil 112*e*. In addition, the distance from the top ends of the first magnetic member 200*e*1 to the top plate 4 is the same as the distance from the top ends of the second magnetic member 200*e*2 to the top plate 4.

With this configuration, a magnetic path that passes through the first magnetic member 200*e*1 and the to-be-heated object 5 on the top plate 4 is formed around the first winding portion 112*e*1. In addition, a magnetic path that passes through the second magnetic member 200*e*2 and the to-be-heated object 5 on the top plate 4 is formed around the second winding portion 112*e*2.

Thus, it is possible to further reduce the degree to which the magnetic field generated by the high-frequency current flowing through the first winding portion 112*e*1 and the magnetic field generated by the high-frequency current flowing through the second winding portion 112*e*2 cancel each other out.

In addition, the top ends of the first magnetic member 200*e*1 and second magnetic member 200*e*2 are formed such that the distance from the top ends of the first magnetic member 200*e*1 to the top plate 4 is the same as the distance from the top ends of the second magnetic member 200*e*2 to the top plate 4. Thus, the magnetic field leakage from the first winding portion 112*e*1 to the second winding portion 112*e*2 side and the magnetic field leakage from the second winding portion 112*e*2 to the first winding portion 112*e*1 side can be reduced.

Note that the shape of the first magnetic member 200*e*1 and that of the second magnetic member 200*e*2 are not limited to the U shape. The shape of the first magnetic member 200*e*1 and that of the second magnetic member 200*e*2 may also be, for example, a concave shape. In addition, the first magnetic member 200*e*1 and the second magnetic member 200*e*2 may also be formed by combining a plurality of plate-shaped ferrite materials. In addition, the adjacent portions of the first magnetic member 200*e*1 and the second magnetic member 200*e*2 may also be formed of a common member.

Embodiment 6

The configuration of an induction heating cooker 100 according to Embodiment 6 will be described mainly on the differences from Embodiments 1 to 5 described above.

Coil Arrangement

Figure 22:
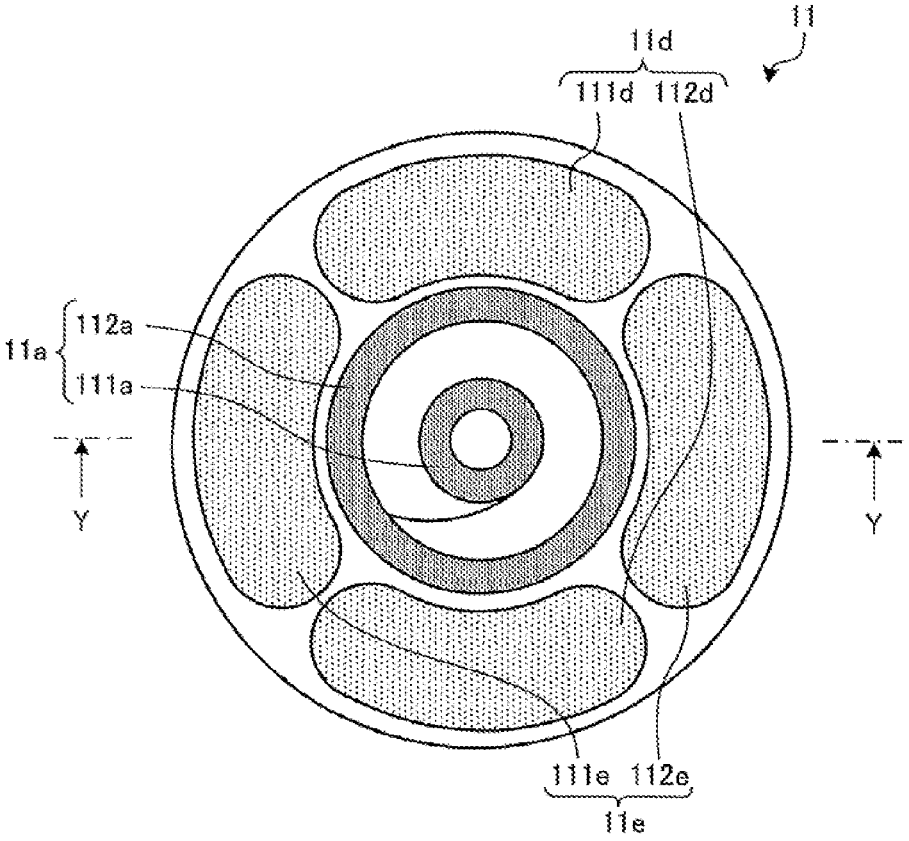
FIG. 22 is a plan view illustrating a first induction heating unit of an induction heating cooker according to Embodiment 6.

FIG. 22 is a plan view illustrating the first induction heating unit of the induction heating cooker according to Embodiment 6.

Figure 23:
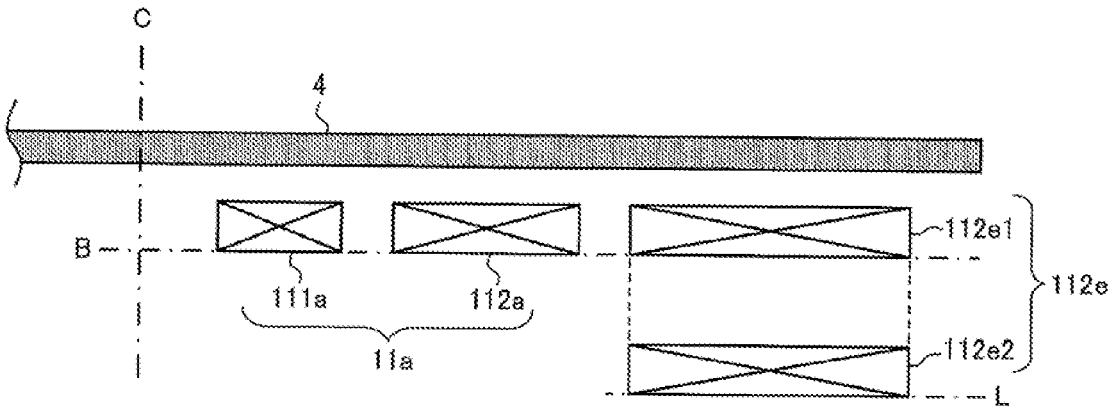
FIG. 23 is a cross section illustrating the arrangement of coils of the induction heating cooker according to Embodiment 6.

FIG. 23 is a cross section illustrating the arrangement of the coils of the induction heating cooker according to Embodiment 6.

Note that FIG. 23 schematically illustrates a Y-Y longitudinal section of FIG. 22. In addition, FIG. 23 illustrates only the right side of the heater area indication from the center C. Note that FIG. 23 illustrates the outer-periphery right coil 112*e* among the individual outer periphery coils; however, the other outer periphery coils are configured substantially the same.

As illustrated in FIGS. 22 and 23, the outer-periphery right coil 112*e* is arranged in a plan view such that the first winding portion 112*e*1 overlies the second winding portion 112*e*2. That is, the individual outer periphery coil is arranged such that the center axis of a tubular-shaped winding obtained by performing winding is in a direction parallel to the top plate 4.

In addition, the inner periphery coil 11*a* and the first winding portion 112*e*1 of the outer-periphery right coil 112*e* are arranged on the reference plane B that is a plane parallel to the top plate 4. The second winding portion 112*e*2 of the outer-periphery right coil 112*e* is arranged on the lower plane L that is a plane parallel to the top plate 4 and located at a distance to the top plate 4, the distance being longer than a distance from the reference plane B to the top plate 4. That is, the first winding portion 112*e*1 of the outer-periphery right coil 112*e* is located at a distance to the top plate 4, the distance being shorter than a distance from the second winding portion 112*e*2 to the top plate.

Note that an area parallel to the top plate 4 may also be increased by widening the width of the first winding portion 112*e*1 of the outer-periphery right coil 112*e*.

Note that the first winding portion 112*e*1 does not have to be arranged so as to entirely overlie the second winding portion 112*e*2 in a plan view, and the first winding portion 112*e*1 and the second winding portion 112*e*2 may also be arranged such that at least a portion of the first winding portion 112*e*1 overlies at least a portion of the second winding portion 112*e*2.

As described above, in Embodiment 6, the distance between the first winding portion 112*e*1 and the top plate 4 is different from the distance between the second winding portion 112*e*2 and the top plate 4.

Thus, when compared with the case where the first winding portion 112*e*1 and the second winding portion 112*e*2 are arranged on the same plane, it is possible to reduce the degree to which the magnetic field generated by the high-frequency current flowing through the first winding portion 112*e*1 and the magnetic field generated by the high-frequency current flowing through the second winding portion 112*e*2 cancel each other out. Thus, a reduction in heat at and the amount of heat generated at the outer periphery region of the to-be-heated object 5 can be suppressed, and the temperature irregularity at the outer periphery region of the to-be-heated object 5 can be reduced.

In addition, in Embodiment 6, the controller 45 drives the driving circuits 50*a*, 50*d*, and 50*e* at the same frequency. In addition, the high-frequency current flowing through the first winding portion of the individual outer periphery coil has the same direction as the high-frequency current flowing through the inner periphery coil 11*a* adjacent to the first winding portion.

Thus, the occurrence of noise due to magnetic interference can be suppressed by high-frequency currents having different frequencies flowing through the adjacent coils.

In addition, the first winding portion 112*e*1 is arranged so to overlie the second winding portion 112*e*2 in a plane view.

Thus, the width of the first winding portion 112*e*1 can be wider than those in Embodiments 1 to 5 described above. Thus, an advantageous effect in further reducing the temperature irregularity at the outer periphery region of the to-be-heated object 5 and increasing heat at and the amount of heat generated at the outer periphery region of the to-be-heated object 5 can be obtained.

Embodiment 7

The configuration of an induction heating cooker 100 according to Embodiment 7 will be described mainly on the differences from Embodiment 6 described above. Note that the arrangement of the individual outer periphery coils is the same as that in Embodiment 6 described above.

Figure 24:
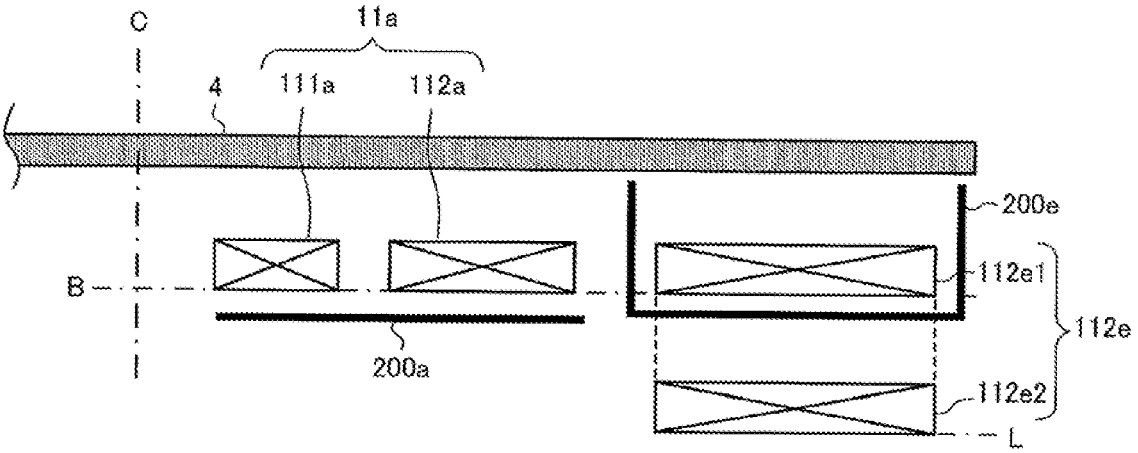
FIG. 24 is a cross section illustrating the arrangement of coils of an induction heating cooker according to Embodiment 7.

FIG. 24 is a cross section illustrating the arrangement of the coils of the induction heating cooker according to Embodiment 7.

Note that FIG. 24 schematically illustrates the Y-Y longitudinal section of FIG. 22. In addition, FIG. 24 illustrates only the right side of the heater area indication from the center C. Note that FIG. 24 illustrates the outer-periphery right coil 112*e* among the individual outer periphery coils; however, the other outer periphery coils are configured substantially the same.

As illustrated in FIG. 24, the induction heating cooker 100 according to Embodiment 7 includes the flat plate-shaped magnetic member 200*a* arranged radially below the inner periphery coil 11*a* in a plan view. The magnetic member 200*a* is formed of, for example, a magnetic material such as ferrite.

In addition, the induction heating cooker 100 includes the first magnetic member 200*e* arranged so as to surround at least a portion of both side surfaces and the bottom of the first winding portion 112*e*1 of the outer-periphery right coil 112*e*. The first magnetic member 200*e* is formed of a U-shaped magnetic material. The first magnetic member 200*e*1 is formed of, for example, a magnetic material such as ferrite. For example, as illustrated in FIG. 24, the top ends of the first magnetic member 200*e*1 are formed so as to be arranged at positions above the top ends of the first winding portion 112*e*1 of the outer-periphery right coil 112*e*.

With this configuration, a magnetic path that passes through the first magnetic member 200*e*1 and the to-be-heated object 5 on the top plate 4 is formed around the first winding portion 112*e*1. Thus, it is possible to further reduce the degree to which the magnetic field generated by the high-frequency current flowing through the first winding portion 112*e*1 and the magnetic field generated by the high-frequency current flowing through the second winding portion 112*e*2 cancel each other out.

In addition, since the top ends of the first magnetic member 200*e*1 are positioned above the top ends of the first winding portion 112*e*1, the magnetic field leakage from the first winding portion 112*e*1 to the second winding portion 112*e*2 side can be reduced.

Note that the shape of the first magnetic member 200*e*1 is not limited to the U shape. The shape of the first magnetic member 200*e*1 may also be, for example, a concave shape. In addition, the first magnetic member 200*e*1 may also be formed by combining a plurality of plate-shaped ferrite materials.

Embodiment 8

An operation of an induction heating cooker 100 according to Embodiment 8 will be described mainly on the differences from Embodiments 1 to 7 described above. Note that the configuration of the induction heating cooker 100 according to Embodiment 8 is the same as any of those in Embodiments 1 to 7 described above.

Operation

When an input operation for starting a heating operation is performed using the operation display unit 43, the controller 45 drives each of the driving circuits 50*a*, 50*d*, and 50*e* in accordance with the input operation, and performs the heating operation to heat the to-be-heated object 5 through induction.

The controller 45 increases the driving frequency of the driving circuit 50*d* and the driving circuit 50*e*, so that the driving frequency of the driving circuit 50*d* and the driving circuit 50*e* is higher than the driving frequency of the driving circuit 50*a* by at least an audio frequency. That is, the controller 45 drives each of the driving circuits 50*d* and 50*e* such that the frequency of the high-frequency current flowing through the individual outer periphery coil becomes higher than the frequency of the high-frequency current flowing through the inner periphery coil 11*a* by at least the audio frequency. For example, the controller 45 drives the driving circuit 50*a* at a driving frequency of 23 kHz, and drives the driving circuit 50*d* and the driving circuit 50*e* at a driving frequency of 90 kHz.

In this case, the audio frequency is the frequency of a sound that can be recognized by the sense of hearing of people. The lower limit of the audio frequency is substantially 20 kHz.

As a result of the operation described above, the occurrence of noise due to magnetic interference can be suppressed by high-frequency currents having different frequencies flowing through the adjacent coils.

In addition, the high-frequency current flowing through the individual outer periphery coil arranged on the outer side of the heater area indication has a higher frequency than the current flowing through the inner periphery coil 11*a*. Thus, it is easier to heat the outer periphery region of the to-be-heated object 5 corresponding to the outer periphery side of the heater area indication, and an advantageous effect in increasing heat at and the amount of heat generated at the outer periphery region of the to-be-heated object 5 can be obtained.

In this case, examples of the to-be-heated object 5 include an item formed of a composite material obtained by attaching a magnetic material to a non-magnetic material. For example, the to-be-heated object 5 is formed by attaching a magnetic material such as stainless steel to the center portion of the bottom of a flying pan made of a non-magnetic material such as aluminum. Note that the magnetic material is attached to the non-magnetic material by using an arbitrary method, examples of which include sticking, welding, thermal spraying, crimping, inlaying, calking, and embedding.

In general, regarding a to-be-heated object 5 formed of a composite material, a magnetic material is attached to a center flat portion of the bottom surface of the base of a non-magnetic material, and no magnetic material is attached to an outer periphery region where the bottom surface is curved. When this to-be-heated object 5 is mounted on a heater area indication among the heater area indications, the magnetic material is mounted on the center of the heater area indication, and the non-magnetic material is mounted on the outer periphery side of the heater area indication.

In the induction heating cooker 100 according to Embodiment 8, since a higher-frequency current flows through the individual outer periphery coils than through the inner periphery coil 11*a*, when the to-be-heated object 5 formed of the above-described composite material is induction heated, high frequency heating can be performed to the non-magnetic material corresponding to the outer periphery region of the to-be-heated object 5 formed of the composite material. Thus, induction heating appropriate for the material of the to-be-heated object 5 can be performed.

Note that a wide band gap semiconductor material may also be used for the switching elements of the driving circuit 50*d* and the driving circuit 50*e* that drive the individual outer periphery coils. By using a wide band gap semiconductor material for the switching elements driven at a high frequency, power loss at the switching elements can be reduced. In addition, heat dissipation from the driving circuits is preferably performed even when the switching frequency is high, and thus the heat dissipation fins of the driving circuits can be more compact, thereby realizing a reduction in the size and cost of the driving circuits.

REFERENCE SIGNS LIST

1 first induction heater area indication 2 second induction heater area indication 3 third induction heater area indication 4 top 5 to-be-heated object 11 first induction heating unit 11*a* inner periphery coil 11*d* outer periphery coil 11*e* outer periphery coil 12 second induction heating unit 13 third induction heating unit 15 current direction 16 current direction 17 current direction 21 alternating-current power supply 22 direct-current power supply circuit 22*a* diode bridge 22*b* reactor 22*c* smoothing capacitor 24*a* resonant capacitor 24*c* resonant capacitor 24*d* resonant capacitor 25*a* input current detection unit 25*b* coil current detection unit 25*c* coil current detection unit 25*d* coil current detection unit 40 operation unit 40*a* operation unit 40*b* operation unit 40*c* operation unit 41 display unit 41*a* display unit 41*b* display unit 41*c* display unit 43 operation display unit 45 controller 48 memory 50 driving circuit 50*a* driving circuit 50*d* driving circuit 50*e* driving circuit 100 induction heating cooker 111*a* inner-periphery inner coil 111*d* outer-periphery upper coil 111*e* outer-periphery left coil 112*a* inner-periphery outer coil 112*d* outer-periphery lower coil 112*e* outer-periphery right coil 112*e*1 first winding portion 112*e*2 second winding portion 112*e*3 third winding portion 112*e*4 fourth winding portion 200*a* magnetic member 200*e*1 first magnetic member 200*e*2 second magnetic member 231*a* IGBT 231*b* IGBT 231*c* diode 231*d* diode 232*a* IGBT 232*b* IGBT 232*c* diode 232*d* diode 233*a* IGBT 233*b* IGBT 233*c* diode 233*d* diode 234*a* IGBT 234*b* IGBT 234*c* diode 234*d* diode 235*a* IGBT 235*b* IGBT 235*c* diode 235*d* diode

The invention claimed is:

1. An induction heating cooker comprising:

a top plate on which a heater area indication indicating a mount position of a to-be-heated object is formed; and a first coil and a second coil each being an annular coil arranged below the heater area indication of the top plate, wherein the second coil includes a first winding portion extending in a circumferential direction of the first coil, and a second winding portion spaced apart from the first winding portion and extending in the circumferential direction of the first coil, and the distance between the first winding portion and the top plate is different from the distance between the second winding portion and the top plate.

2. The induction heating cooker of claim 1, wherein
the first coil and the first winding portion of the second coil are
arranged on a reference plane that is a plane parallel to the top plate, and
the second winding portion of the second coil is
arranged on an upper plane that is a plane parallel to the top plate and located at a distance to the top plate, the distance being shorter than a distance from the reference plane to the top plate.

3. The induction heating cooker of claim 1, wherein
the first coil is
arranged on a reference plane that is a plane parallel to the top plate, and
the second coil is
arranged on an upward inclined plane that is inclined upward from an outer peripheral side of the first coil toward an outer peripheral side of the heater area indication and that intersects the reference plane.

4. The induction heating cooker of claim 1, wherein
the first coil is
arranged on a reference plane that is a plane parallel to the top plate,
the first winding portion of the second coil is
arranged on an upward inclined plane that is a plane inclined upward from an outer peripheral side of the first coil toward an outer peripheral side of the heater area indication and intersecting the reference plane, and
the second winding portion of the second coil is
arranged on an upper plane that is a plane parallel to the top plate and located at a distance to the top plate, the distance being shorter than a distance from the reference plane to the top plate.

5. The induction heating cooker of claim 1, wherein
the first coil and the first winding portion of the second coil are
arranged on a reference plane that is a plane parallel to the top plate, and
the second winding portion of the second coil is
arranged on an upward inclined plane that is a plane inclined upward from an outer peripheral side of the first coil toward an outer peripheral side of the heater area indication and intersecting the reference plane.

6. The induction heating cooker of claim 1, wherein
the first coil and the first winding portion of the second coil are
arranged on a reference plane that is a plane parallel to the top plate, and
the second winding portion of the second coil is
arranged on a lower plane that is a plane parallel to the top plate and located at a distance to the top plate, the distance being longer than a distance from the reference plane to the top plate.

7. The induction heating cooker of claim 1, wherein
the first coil is
arranged on a reference plane that is a plane parallel to the top plate, and
the second coil is
arranged on a downward inclined plane that is inclined downward from an outer peripheral side of the first coil toward an outer peripheral side of the heater area indication and that intersects the reference plane.

8. The induction heating cooker of claim 1, wherein
the first coil is
arranged on a reference plane that is a plane parallel to the top plate,
the first winding portion of the second coil is
arranged on a downward inclined plane that is a plane inclined downward from an outer peripheral side of the first coil toward an outer peripheral side of the heater area indication and intersecting the reference plane, and
the second winding portion of the second coil is
arranged on a lower plane that is a plane parallel to the top plate and located at a distance to the top plate, the distance being longer than a distance from the reference plane to the top plate.

9. The induction heating cooker of claim 1, wherein
the first coil and the first winding portion of the second coil are
arranged on a reference plane that is a plane parallel to the top plate, and
the second winding portion of the second coil is
arranged on a downward inclined plane that is a plane inclined downward from an outer peripheral side of the first coil toward an outer peripheral side of the heater area indication and intersecting the reference plane.

10. The induction heating cooker of claim 1, wherein
in the second coil,
in a plan view, at least a portion of the first winding portion is arranged at a position superposed with the first coil.

11. The induction heating cooker of claim 10, wherein
the first coil and the second winding portion of the second coil are
arranged on a reference plane that is a plane parallel to the top plate, and
the first winding portion of the second coil is
arranged on a lower plane that is a plane parallel to the top plate and located at a distance to the top plate, the distance being longer than a distance from the reference plane to the top plate.

12. The induction heating cooker of claim 10, wherein
the first coil and the second winding portion of the second coil are
arranged on a reference plane that is a plane parallel to the top plate, and
the first winding portion of the second coil is
arranged on an upper plane that is a plane parallel to the top plate and located at a distance to the top plate, the distance being shorter than the reference plane to the top plate.

13. The induction heating cooker of claim 10, wherein
the first coil is
arranged on a reference plane that is a plane parallel to the top plate,
the first winding portion of the second coil is
arranged on a lower plane that is a plane parallel to the top plate and located at a distance to the top plate, the distance being longer than the reference plane is to the top plate, and
the second winding portion of the second coil is
arranged on an upward inclined plane that is a plane inclined upward from an outer peripheral side of the first coil toward an outer peripheral side of the heater area indication and intersecting the reference plane.

14. The induction heating cooker of claim 10, wherein
the first coil is
arranged on a reference plane that is a plane parallel to the top plate, the first winding portion of the second coil is arranged on an upper plane that is a plane parallel to the top plate and located at a distance to the top plate, the distance being shorter than a distance from the reference plane to the top plate, and the second winding portion of the second coil is arranged on a downward inclined plane that is a plane inclined downward from an outer peripheral side of the first coil toward an outer peripheral side of the heater area indication and intersecting the reference plane.

15. The induction heating cooker of claim 1, comprising:

a first magnetic member that is formed of a U-shaped magnetic material and is arranged to surround at least a portion of both side surfaces and a bottom of the first winding portion of the second coil; and a second magnetic member that is formed of a U-shaped magnetic material and is arranged to surround at least a portion of both side surfaces and a bottom of the second winding portion of the second coil.

16. The induction heating cooker of claim 15, wherein the distance between a top end of the first magnetic member and the top plate is the same as the distance between a top end of the second magnetic member and the top plate.

17. The induction heating cooker of claim 1, wherein the second coil is arranged such that the first winding portion is superposed with the second winding portion in a plan view.

18. The induction heating cooker of claim 17, wherein the first coil and the first winding portion of the second coil are arranged on a reference plane that is a plane parallel to the top plate, and the second winding portion of the second coil is arranged below the reference plane.

19. The induction heating cooker of claim 17, comprising:

a first magnetic member that is formed of a U-shaped magnetic material and is arranged to surround at least a portion of both side surfaces and a bottom of the first winding portion of the second coil.

20. The induction heating cooker of claim 1, comprising:

a first inverter circuit that supplies a first high-frequency current to the first coil;

a second inverter circuit that supplies a second high-frequency current to the second coil; and a controller that controls driving of the first inverter circuit and the second inverter circuit, wherein the controller drives the first inverter circuit and the second inverter circuit such that the first high-frequency current has the same frequency as the second high-frequency current and the second high-frequency current flowing through the first winding portion of the second coil has the same direction as the first high-frequency current flowing through the first coil adjacent to the first winding portion.

21. The induction heating cooker of claim 1, comprising:

a first inverter circuit that supplies a first high-frequency current to the first coil;

a second inverter circuit that supplies a second high-frequency current to the second coil; and a controller that controls driving of the first inverter circuit and the second inverter circuit, wherein the first coil is arranged at the center of the heater area indication, the second coil is arranged closer to an outer side of the heater area indication than the first coil is to the outer side of the heater area indication, and the controller drives the first inverter circuit and the second inverter circuit such that the frequency of the second high-frequency current becomes higher than the frequency of the first high-frequency current by at least an audio frequency.

22. The induction heating cooker of claim 21, wherein in the second inverter circuit, a switching element is formed of a wide band gap semiconductor material.

* * * * *